US005231859A

United States Patent [19]

Bailey

[11] Patent Number: 5,231,859

[45] Date of Patent: Aug. 3, 1993

[54] FLUTING MACHINE

[75] Inventor: Kenneth S. Bailey, Pendergrass, Ga.

[73] Assignee: TrimbleHouse Corporation, Norcross, Ga.

[21] Appl. No.: 845,053

[22] Filed: Mar. 3, 1992

[51] Int. Cl.[5] ..... B21B 17/08; B21B 37/08

[52] U.S. Cl. ..... 72/20; 72/208; 72/283; 72/402

[58] Field of Search ..... 72/20, 208, 209, 220, 72/274, 278, 283, 285, 370, 402

[56] References Cited

U.S. PATENT DOCUMENTS

| | | | |
|---|---|---|---|
| 838,569 | 12/1906 | Numan | 72/208 |
| 1,605,828 | 11/1926 | Frahm | 72/208 |
| 1,638,481 | 8/1927 | Frahm | 72/208 |
| 3,112,661 | 12/1963 | Coe | 72/208 |
| 3,238,752 | 3/1966 | Dilling | 72/285 |
| 3,330,145 | 7/1967 | Adolphi | 72/274 |
| 3,841,125 | 10/1974 | Guse | 72/402 |
| 4,186,585 | 2/1980 | Passoni et al. | 72/208 |
| 4,345,453 | 8/1982 | Lillbacka | 72/402 |

FOREIGN PATENT DOCUMENTS

| | | | |
|---|---|---|---|
| 0006565 | 2/1983 | Japan | 72/209 |

*Primary Examiner*—Lowell A. Larson
*Assistant Examiner*—Thomas C. Schoeffler
*Attorney, Agent, or Firm*—Hopkins & Thomas

[57] ABSTRACT

A fluting machine and method produce fluted poles. The fluting machine has an aperture means, a carriage, and a track configured so that the carriage can travel on the track toward the aperture means. The carriage has a fluted mandrel for holding a pipe to be fluted. The carriage carries the fluted mandrel and pipe parallel to the track to and from the aperture means at a constant speed irrespective of any fluctuations in driving resistance. The aperture means has a stationary inner part, a rotatable outer head, and a set of rotatory dies. The rotatory dies are circumferentially situated about and perpendicularly extendable within an aperture opening defined by the stationary inner part. The aperture opening is for accepting the fluted mandrel and pipe therethrough. The rotatable outer head causes extension of the rotatory dies within the aperture opening and against the pipe when the rotatable outer head is rotated. The rotatory dies roll along the length of the pipe on the fluted mandrel at constant pressure to thereby produce flutes in the pipe.

17 Claims, 18 Drawing Sheets

78a
ASTERN 1/4" VALVE (N.O.)
78b
ASTERN 3/8" VALVE (N.O.)
78c
ASTERN 1/4" VALVE (N.O.)
78d
ASTERN 3/8" VALVE (N.O.)
83
ASTERN DUMP VALVE (N.C.)
ASTERN MANIFOLD
78
71
CARRIAGE HYDRAULIC PUMP
CK
91
72
REVERSABLE HYDRAULIC MOTOR
86
RETURN MANIFOLD
85
HYDR. FLUID SUPPLY TANK
89
82'
AHEAD MANIFOLD
82a
AHEAD 1/4" VALVE (N.O.)
82b
AHEAD 3/8" VALVE (N.O.)
82c
AHEAD 1/4" VALVE (N.O.)
82d
AHEAD 3/8" VALVE (N.O.)
84
AHEAD DUMP VALVE (N.C.)

FLUTING MACHINE

BACKGROUND OF THE INVENTION

Field Of The Invention

The present invention relates to metal working and, more particularly, to a fluting machine and method of producing fluted poles for lamp posts and other various applications by bending metal pipes.

Description of Related Art

For many years in our society, fluted poles have been used in the construction of lamp posts, as shown by reference numeral 11 in FIG. 1, because of their aesthetic ornamental appearance. Essentially, "flutes" are the indentations, or depressions, in the sides of a fluted pole 12. Fluted poles can take various configurations. They are generally tapered. They can possess a square or a circular cross section. They can be formed with differing numbers of flutes, for example, eight, twelve, sixteen, or thirty two flutes. Finally, the fluted poles can be constructed from soft metals, such as aluminum, or from stronger metals, such as a heavy gauge steel.

At first, fluted poles were made by grinding flutes, or indentations, into the outer circumference of a square or round pipe. This archaic rudimentary process was time consuming, to say the least. Flute uniformity was also lacking. Furthermore, the fluted poles were weak due to thickness variations in the fluted pole.

In 1906, a company known as Union Metal Corporation, located in Canton, Ohio, U.S.A., developed a method and apparatus for making fluted poles in a much faster and more efficient manner than in the past. The apparatus bent pipe into a fluted configuration by using hydraulic technology, which was in a state of infancy at the time. At present, Union Metal has been making fluted poles in this manner for over eighty years.

Essentially, the Union Metal apparatus has a mandrel for supporting a pipe to be converted into a fluted pole. The mandrel is moved longitudinally through a head via a hydraulic cylinder attached to one end of the mandrel. The head has eight hydraulic cylinders which basically press a set of eight roller-like, V-shaped dies within an opening at the center of the head through which the mandrel is passed. The eight dies are situated symmetrically around the head opening so as to create a symmetric fluted pole.

In operation, the dies are extended into the head opening. Next, the mandrel is forced by its associated hydraulic cylinder to carry a pipe through the head opening, while the dies bend flutes into the pipe to thereby form a fluted pole. In order to remove the fluted pole from the mandrel, the fluted pole is generally pulled off of the mandrel. In order to facilitate removal, the mandrel is often oiled with a heavy black oil. A heavy brace is positioned in front of the mandrel. Then, a ring is placed around the back end of the mandrel and is pulled forward so as to pull the fluted pole from the mandrel. A mandrel vibrator is sometimes employed to aid in separating the fluted pole from the mandrel.

Although very innovative for its time, the Union Metal apparatus and associated methodology suffers from various design and implementation problems. First, the process is very slow. Only 5 or 6 fluted poles can be manufactured in an hour.

During the removal process, the fluted poles are often destroyed in whole or in part. It is common for 3 to 4 feet of a pole to be torn by the removal apparatus.

The hydraulic systems of the Union Metal apparatus contribute other even more fundamental problems. The hydraulic systems have many operational variables which lead to inaccurate control and varying fluted pole quality. For instance, the hydraulic cylinders in the head do not maintain equal die pressures around the circumference of the mandrel. As a result, the pipe bends too much or too little, is bowed, and/or is difficult to remove from the mandrel. Also, after continued operation, the mandrel eventually progresses to the bottom of the head. Consequently, the hydraulic feed to the die cylinders must be re-adjusted very often.

The hydraulic cylinders in the head must be overhauled frequently. Thus, the heads are designed to be interchangeable so that while one head is being overhauled, another can be in operation.

When the mandrel hydraulic cylinder carries a pipe through the head opening, the mandrel hydraulic cylinder does not maintain a constant drive speed, because of varying resistances against the drive force. The varying resistances are caused by the varying metallurgical characteristics of the pipe. In other words, some areas of the pipe are hard, while other areas are soft, or more malleable.

Because of the mandrel hydraulic cylinder design, the pipes can be bent only in one driving direction. In order to pass the mandrel with a pipe through the head a second time, if necessary, the dies must be retracted so that the mandrel hydraulic cylinder can be pulled back to its starting position behind the head.

Finally, because of the rudimentary design of the hydraulic die cylinders, every time a pipe material changes, all of the hydraulic settings must be reconfigured. For example, if the Union Metal apparatus were being converted from working on heavy steel pipes to working on aluminum pipes, then the hydraulic die cylinders need to be fed less hydraulic pressure so as to compensate for the softer metal. This reconfiguration process is time consuming and is undesirably imprecise.

SUMMARY OF THE INVENTION

An object of the present invention is to provide a fluting machine which is simple in design for easy repair, functional and durable in structure, and efficient in operation.

Another object of the present invention is to provide a fluting machine which has a head characterized by a hydraulic means controlling a mechanical means to thereby induce uniform hydraulic pressure on all rotatory dies situated around the fluted mandrel.

Another object of the present invention is to provide a fluting machine and method for bending pipe to form a fluted pole without causing the pipe to undesirably buckle.

Another object of the present invention is to provide a fluting machine and method which can produce fluted poles at a high speed, for example, at least 20 fluted poles in an hour.

Another object of the present invention is to provide a fluting machine and method which neither over rolls nor under rolls the fluted poles.

Another object of the present invention is to provide a fluting machine and method which can compensate for varying strengths of the pipe metal.

Another object of the present invention is to provide a fluting machine and method which permits easy changeover from one metal to another, for example, a changeover from 11-gauge aluminum to 0.25" steel, without making any adjustments.

Another object of the present invention is to provide a fluting machine and method which can force the fluted mandrel through the head with sufficient force in either driving direction to effectuate fluting.

Another object of the present invention is to provide a fluting machine and method which can be used to make square tapered poles out of round poles.

Another object of the present invention is to provide a fluting machine and method which permits the rotatory dies to back up or administer more pressure as the fluted mandrel with pipe travels through the head at, respectively, slower or faster speeds.

Another object of the present invention is to provide a fluting machine and method for producing many types of fluted pipes, such as fluted pipes having any even number of flutes.

Another object of the present invention is to provide a fluting machine and method for producing fluted pipes which are tapered from one end to the other.

Another object of the present invention is to provide a fluting machine and method which permits easy entry of a new pipe and removal of the finished fluted pole without damage.

Another object of the present invention is to provide a fluting machine and method for allowing easy removal of the fluted pole from the machine without the need to put oil on the fluted mandrel.

Another object of the present invention is to provide a fluting machine and method for producing a fluted pole wherein the thickness of the fluted pole remains uniform throughout. Such uniformity results in a strong fluted pipe.

Other objects, features, and advantages of the present invention will become apparent from the following description when considered in conjunction with the accompanying drawings.

Generally, the present invention is a fluting machine and methods for producing fluted poles. From a high level conceptual vantage point, the fluting machine comprises a track, a carriage, and an aperture means. The carriage rides on the track and carries a fluted mandrel parallel to the track. Moreover, the fluted mandrel holds a pipe to be fluted by the fluting machine. The aperture means has rotatory dies circumferentially situated about an aperture opening for accepting the mandrel therethrough. The rotatory dies are movable perpendicular to the fluted mandrel. Moreover, the rotatory dies can be extended into the aperture opening so as to contact the pipe and produce flutes in the pipe.

In operation, a pipe is positioned about the fluted mandrel. Then, the pipe and fluted mandrel are driven through the aperture means while the rotatory dies are extended into the aperture opening. As the pipe progresses through the aperture means, the rotatory dies press against the pipe. Flutes are bent in the pipe, and accordingly, the pipe is ultimately converted into a fluted pole.

BRIEF DESCRIPTION OF THE DRAWINGS

The present invention, as defined in the claims, can be better understood with reference to the following drawings. The drawings are not necessarily to scale, emphasis instead being placed upon clearly illustrating principals of the present invention.

FIG. 15A shows the sled in operation; FIG. 15B shows the inoperative sled with a sled arm retracted; and FIG. 15C shows the base of the sled arm moved along a track;

FIG. 22 shows a finished fluted pole having 8 flutes; FIG. 23 shows a finished pole having 12 flutes; and FIG. 24 shows a finished pole having 16 flutes.

DETAILED DESCRIPTION OF THE PREFERRED EMBODIMENT

I. Architecture of Fluting Machine

Figure 1:
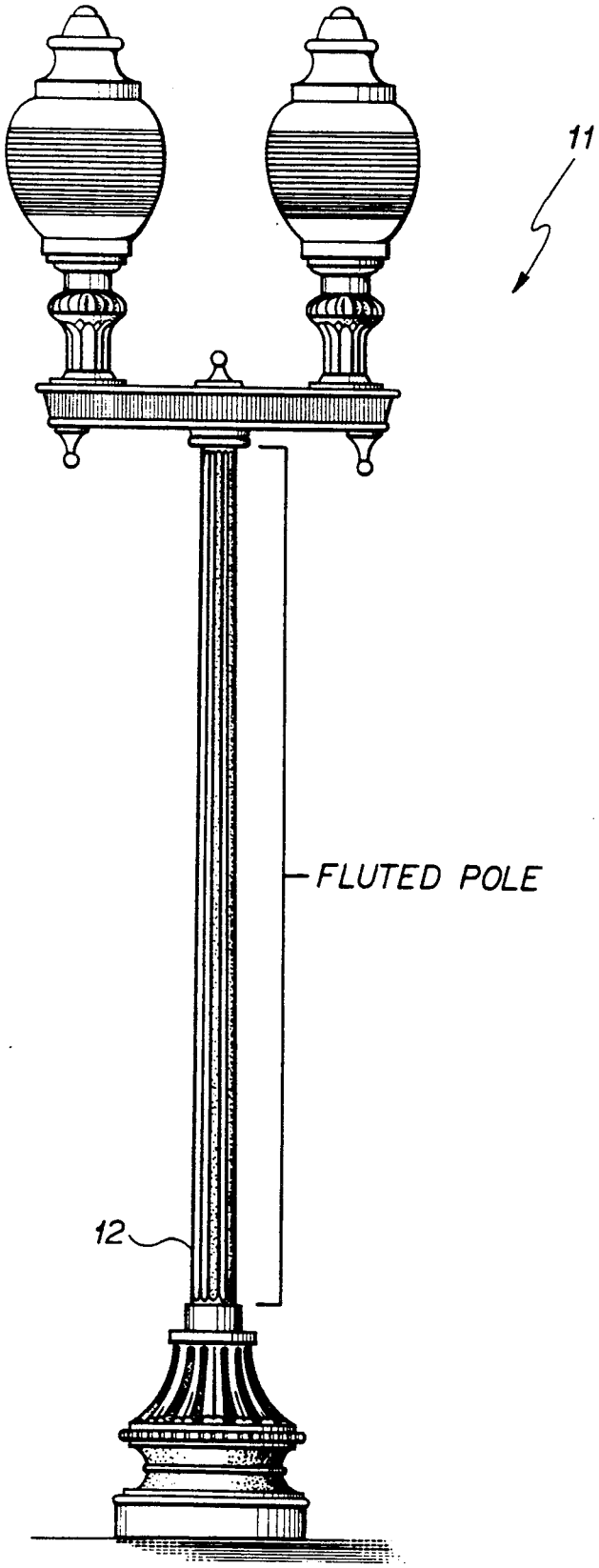
FIG. 1 shows a frontal view of a conventional lamp post having a fluted pole.
Figure 2:
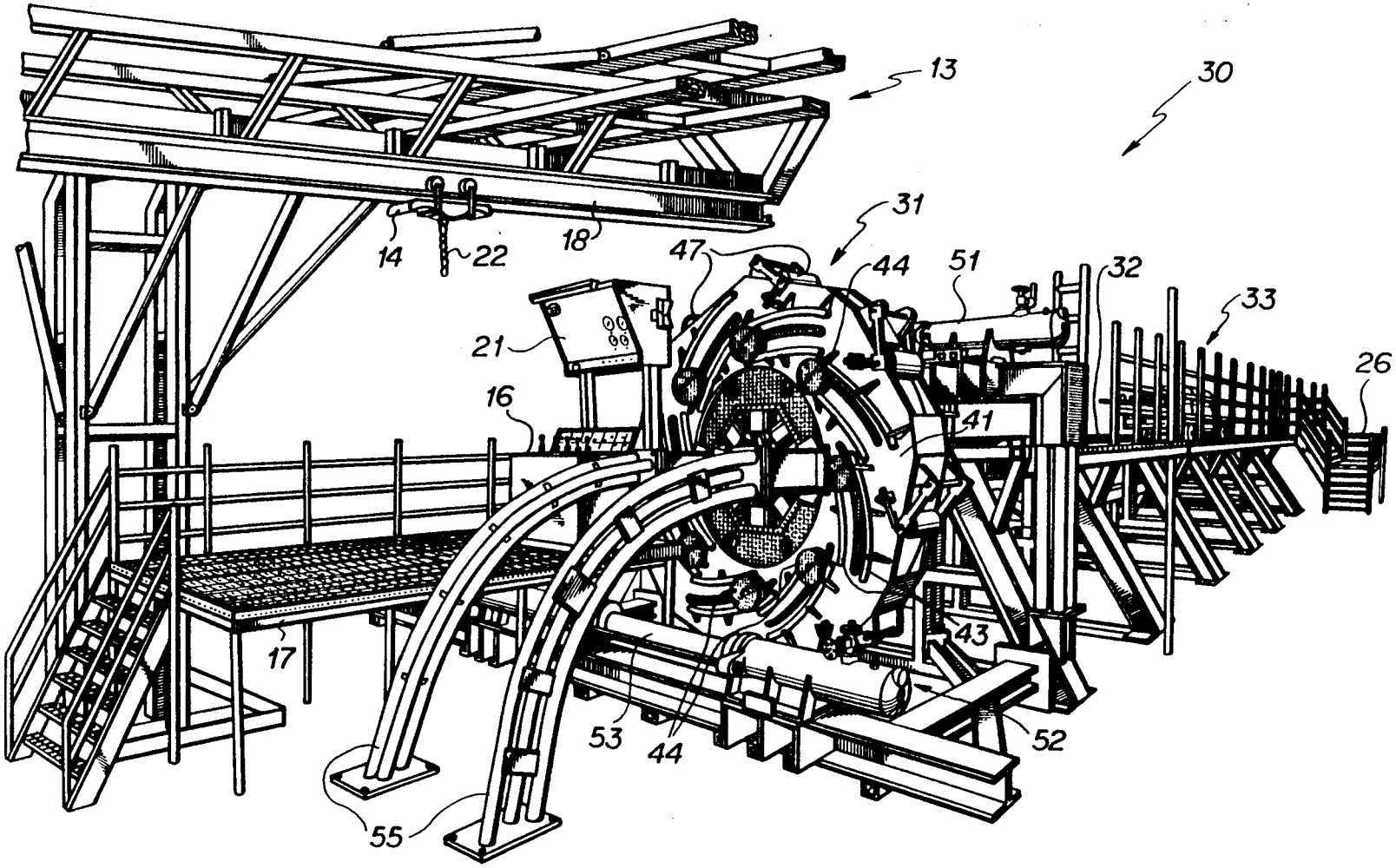
FIG. 2 illustrates a perspective view of the fluting machine in accordance with the present invention for producing the fluted pole used in the lamp post of FIG. 1.

Referring now in detail to the preferred embodiment chosen for the purpose of illustrating the present invention, FIG. 2 shows a fluting machine 30 having an aperture means 31 at the front, a track 32, and a carriage 33 at the rear. The carriage 33 is adapted to travel along the track 32 toward the aperture means 31 while carrying a pipe so as to permit the aperture means 31 to produce flutes in the pipe.

Figure 3:
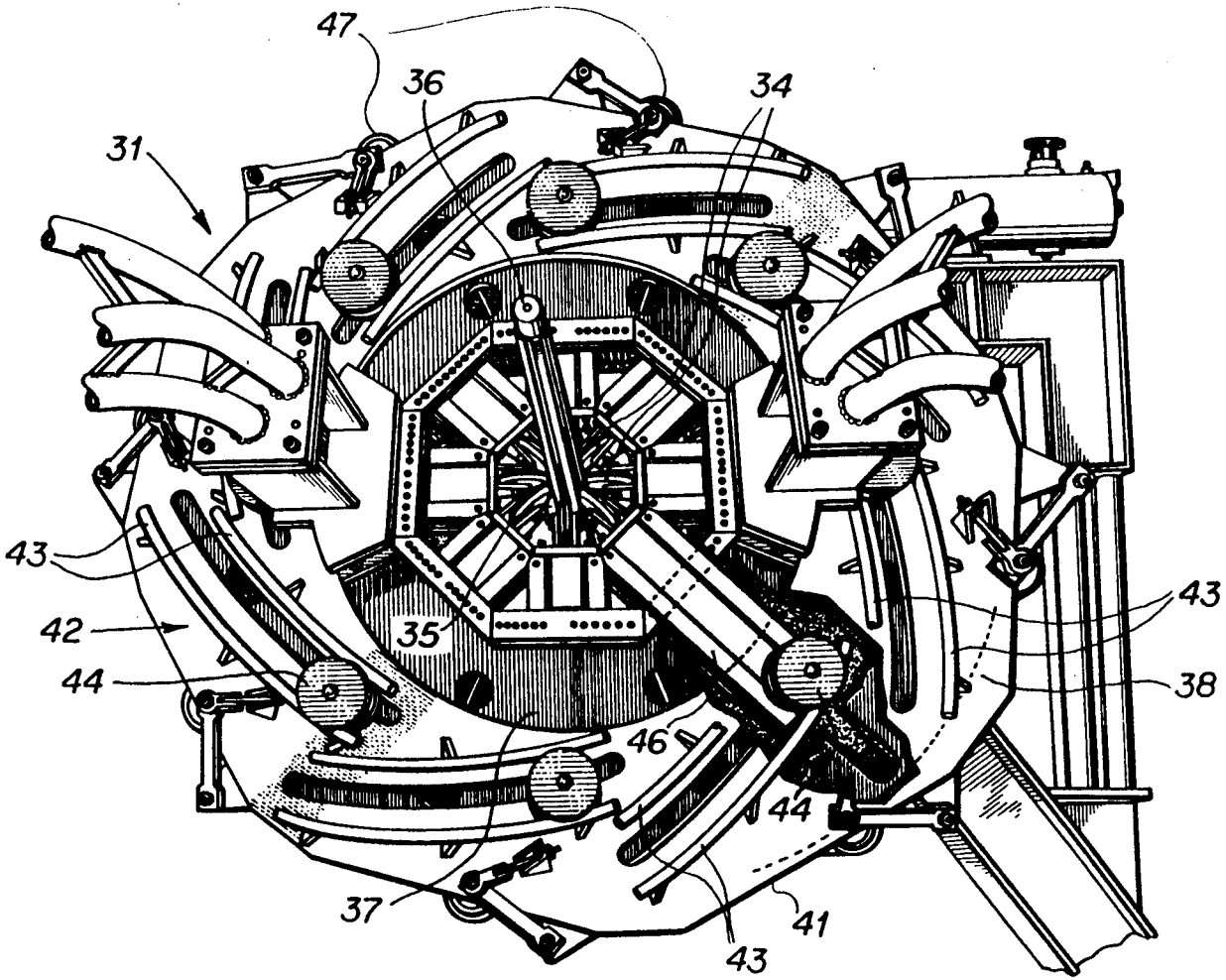
FIG. 3 illustrates an enlarged frontal view of the aperture means of FIG. 2 with a cut-away sectional view showing a die.

As shown in FIG. 3, the aperture means 31 has rotatory dies 34 circumferentially situated about an aperture opening 35 for accepting a fluted mandrel 36 therethrough. The fluted mandrel 36 is mounted to and driven by the carriage 33. The rotatory dies 34 are movable perpendicular to the fluted mandrel 36 so that each of the rotatory dies 34 can be extended into the aperture opening 35 to produce a flute in the pipe residing on the fluted mandrel 36.

For the purpose of retracting and extending the rotatory dies 34 into the aperture opening 35, the aperture means 31 comprises a stationary inner part 37, whose outer boundary is denoted by a phantom line 38, and a rotatable outer head 41. The rotatable outer head 41 has a cam means 42 corresponding to each of the rotatory dies 34. Each cam means 42 includes a set of curvilinear tracks 43 for driving a roller 44 upon rotation of the rotatable outer head 41. The movement of the roller 44 along the curvilinear tracks 43 causes a die piston 46 to either progressively extend or progressively retract a die 34 depending upon the rotation direction of the rotatable outer head 41.

The rotatable outer head 41 is held in peripheral boundaries by eight rollers 47. The rollers 47 are positioned symmetrically around the rotatable outer head 41.

Figure 4:
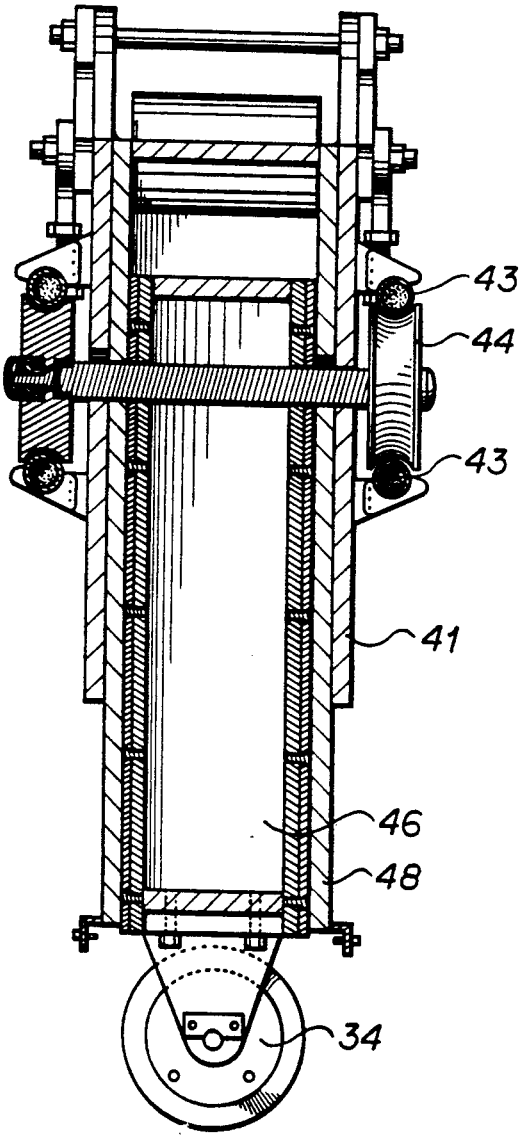
FIG. 4 illustrates a cross-sectional view of the die shown in FIG. 3 having a retracted die piston.
Figure 5:
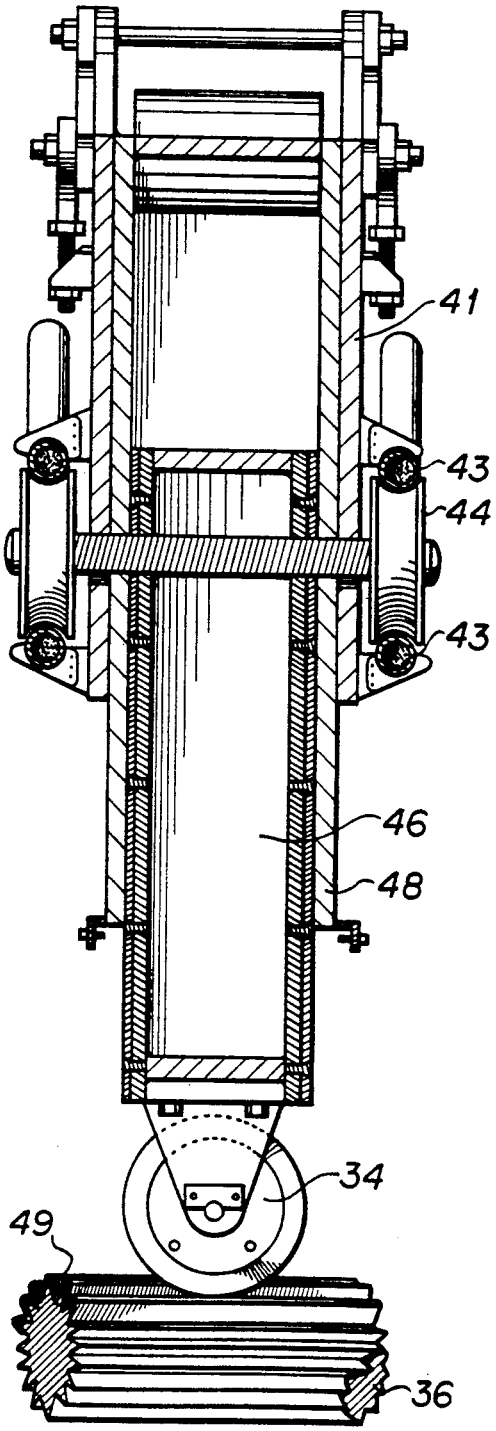
FIG. 5 shows a cross-sectional view of the die of FIGS. 3 and 4 having the die piston extended to contact a pipe on a fluted mandrel.

FIGS. 4 and 5 illustrate retraction and extension of the die piston 46, respectively. As shown in FIG. 4, the die piston 46 is shown to exist in a retracted position within a cylindrical die holder 48. As the rotatable outer head 41 is moved in the counterclockwise direction, the die piston 46 is forced by the roller 44 to extend out of the die holder 48 so as to permit contact of the die 34 with a pipe 49 residing on the fluted mandrel 36, as shown in FIG. 5.

Figure 6:
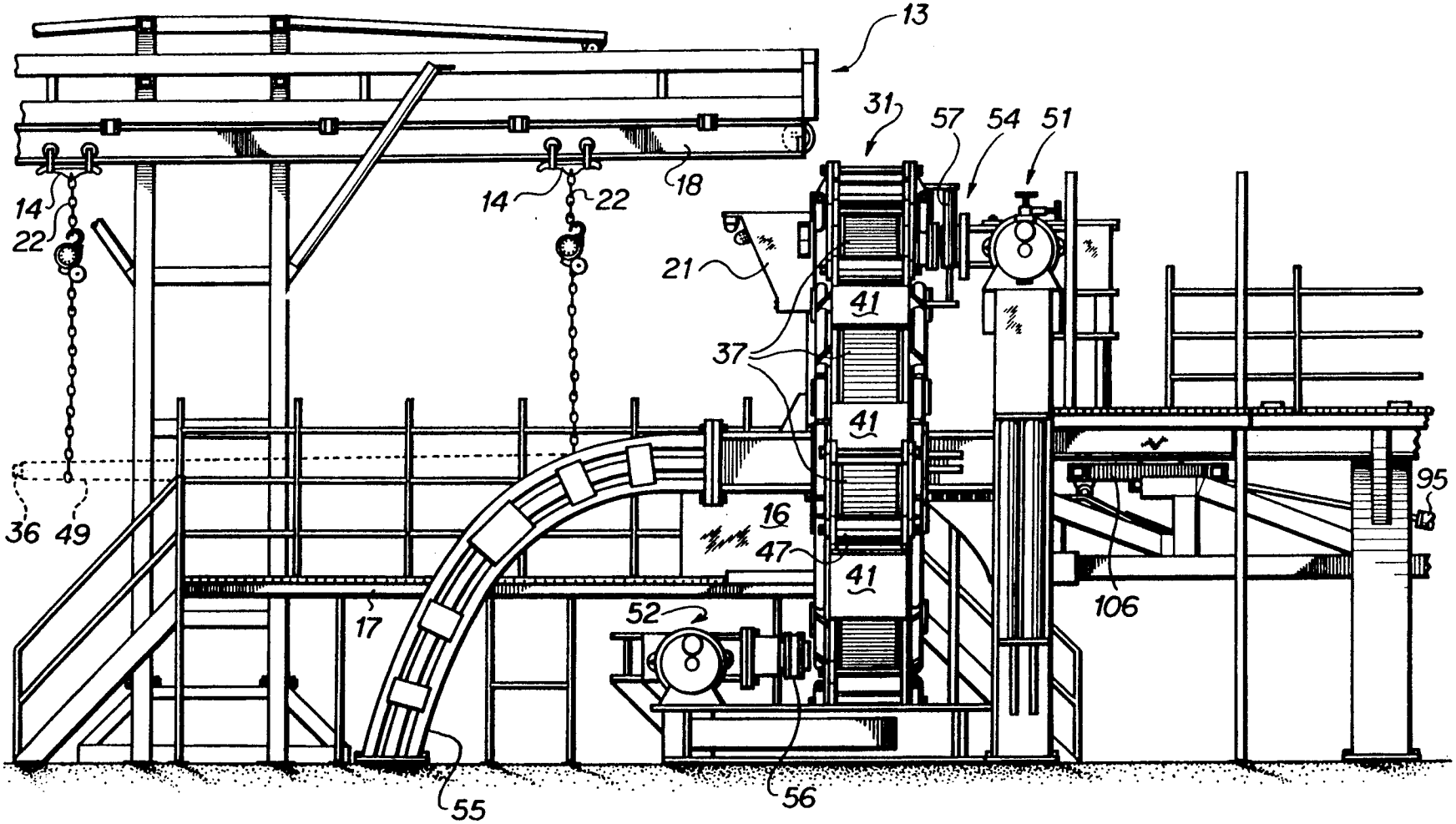
FIG. 6 shows a right hand side view of the aperture means of FIGS. 2 and 3.

Rotation of the rotatable outer head 41 of the aperture means 31 is accomplished by an aperture hydraulic system. Two separate hydraulic mechanisms effectuate the rotation. A first hydraulic mechanism 51 is situated at the top inboard side of the rotatable outer head 41, as shown in FIG. 6. Furthermore, a second hydraulic mechanism 52 is situated at the outboard side bottom of the rotatable outer head 41.

Each of the hydraulic mechanisms 51, 52 have two hydraulic cylinders connected together by a single rod. The cylinders are stationary, while the rod is movable linearly therebetween. FIG. 2 illustrates a rod 53 corresponding to the hydraulic mechanism 51 at the front bottom of the aperture means 31. Moreover, each of the movable rods is connected to the rotatable outer head 41 via a mounting means 54. Consequently, when the rotatable outer head 41 moves in a clockwise rotation, the rod corresponding to hydraulic mechanism 51 is hydraulically forced from left to right, whereas the rod corresponding to hydraulic mechanism 52 is hydraulically forced from right to left. Conversely, when the rotatable outer head 41 moves in a counterclockwise rotation, the rod corresponding to the hydraulic mechanism 52 is hydraulically forced from left to right, whereas the rod corresponding to the hydraulic mechanism 51 is hydraulically forced from right to left.

In the preferred embodiment, the mounting means 54 comprises a roller 56 affixed to the rod of the corresponding hydraulic mechanism 51, 52. The roller 56 rides within two stationary straight tubes 57 affixed to the rotatable outer head 41. As the rotatable outer head 41 rotates, the straight tubes 57 allow the rollers 56 to move up and down so as to maintain engagement of the rod with the rotatable outer head 41. Hence, hydraulic linear force from the hydraulic mechanisms 51, 52 is converted to rotating force on the rotatable outer head 41.

Worth noting is the aperture means 31 in accordance with the present invention is characterized by hydraulics means (hydraulic mechanisms 51, 52) controlling a mechanics means (rotatable outer head 41, curvilinear tracks 43, rollers 44, die piston 46, rotatory dies 34). Because of the foregoing configuration, uniform hydraulic pressure is induced on all rotatory dies situated around the fluted mandrel. As a result, pipes are not bent too much or too little in certain circumference areas, are not bowed, and are easily removed from the fluted mandrel 36. Also, after continued operation, the fluted mandrel does not progress to the bottom of the head.

Figure 7:
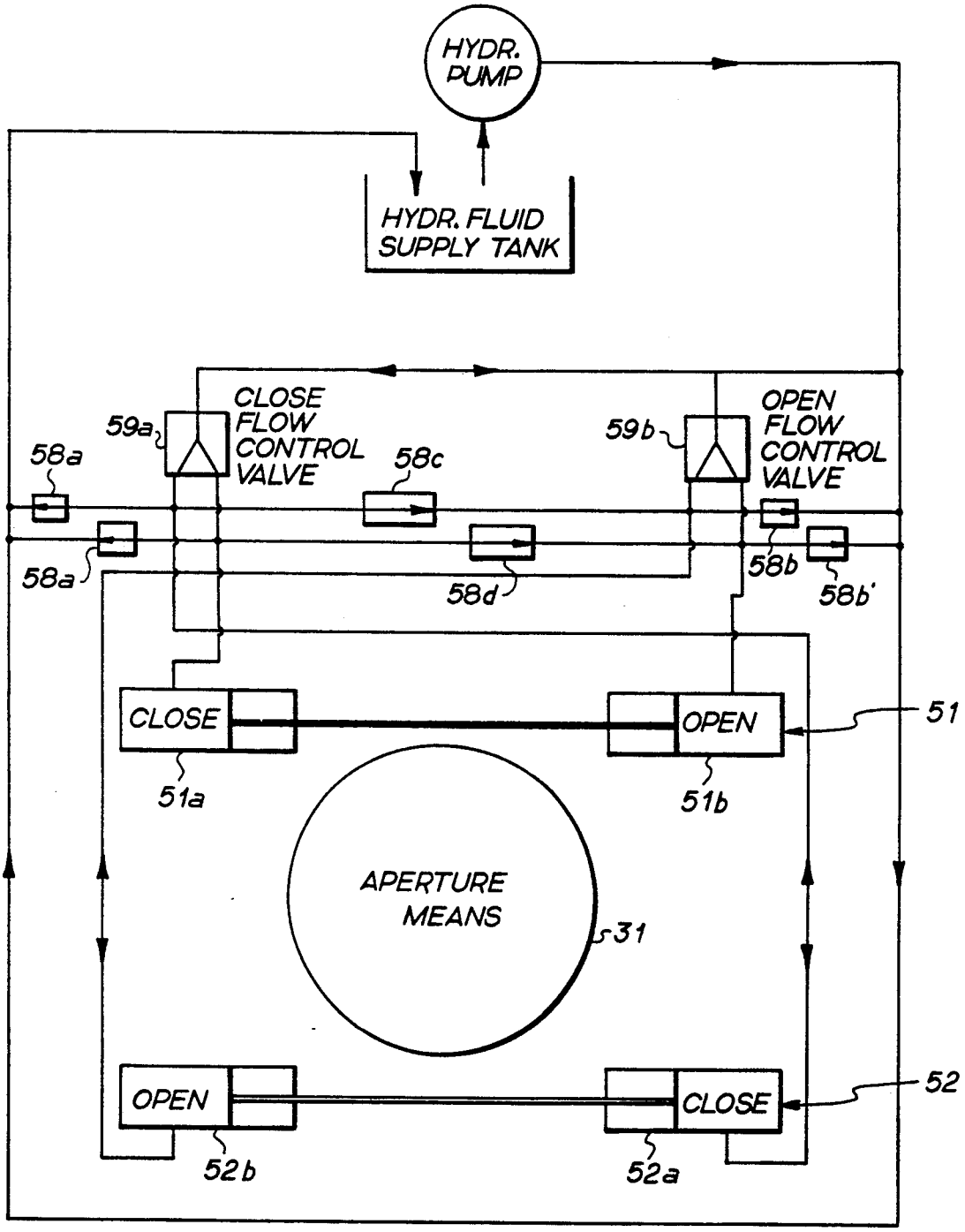
FIG. 7 is a block diagramic view of the aperture hydraulic system corresponding to the aperture means of FIGS. 2, 3, and 6.

FIG. 7 shows a schematic diagram of the aperture hydraulic system. Significantly, the rotatory dies 34 can back up slightly or administer more pressure as the fluted mandrel with pipe 49 attempts to travel through the head at, respectively, slower or faster speeds, so as to maintain constant pressure on the rotatory dies 34. The foregoing functionality is made possible by a network of relief valves **58*a*–58*d***.

With reference to FIG. 7, a "close" flow control valve **59*a* and an "open" flow control valve 59*b* are disposed and manually controlled to cause the aperture means 31 to open and close, thereby causing the dies 34 to respectively extend into or be retracted from the aperture opening 35. The close flow control valve 59*a* is adapted to either provide pressurized hydraulic fluid to close cylinders 51*a*, 52*a*, or serve as a free flow return for the close cylinders 51*a*, 52*a*. The open flow control valve 59*b* is adapted to either provide pressurized hydraulic fluid to open cylinders 51*b*, 52*b*, or serve as a free flow return for the close cylinders 51*b*, 52*b***.

As further shown, a network of relief valves **58*a*–58*d* is implemented to maintain constant pressure on the rotatory dies 34, notwithstanding any fluctuations in the speed of the mandrel 36. Relief valves 58*a*, 58*a'* are disposed to permit hydraulic to flow into the hydraulic return line when sufficient pressure has built up in the close cylinders 51*a*, 52*a* to surpass its pressure setting, or threshold. Relief valves 58*b*, 58*b'* are disposed to permit hydraulic to flow into the hydraulic return line when sufficient pressure has built up in the open cylinders 51*b*, 52*b*** to surpass its pressure threshold.

Relief valves **58*c*, 58*d* are disposed to permit pressurized hydraulic to flow from the close cylinders 51*a*, 52*a* into the respective open cylinders 51*b*, 52*b* when sufficient pressure has built up in the close cylinders 51*a*, 52*a*** to surpass another pressure threshold. The pressure threshold of relief valves 58*c* and 58*d* is preferably a magnitude higher than the pressure threshold for relief valves 58*a*, 58*a'*, 58*b*, 58*b'*. In essence, the relief valves 58*c*, 58*d* further aid in maintaining constant pressure on the mandrel 36 passing through the aperture opening 35.

In operation, the close flow control valve 59*a* is utilized to "close" the aperture opening 35 with the rotatory dies 34. The close flow control valve 59*a* provides pressurized hydraulic fluid to the close cylinders 51*a*, 52*a* to thereby impress the rotatory dies 34 against the mandrel 36 having a pipe. As hydraulic fluid is provided to the close cylinders 51*a*, 52*a*, hydraulic fluid is permitted to free flow through the open flow control valve 59*b* and return back into the close flow control valve 59*a* along with any additional fluid from the hydraulic pump. If the rotatory dies 34 experience more resistance to pressure on the pipe and mandrel 36, resulting from material composition disparities or a change in mandrel speed, the relief valves 58*a*, 58*a'* allow any additional pressure to be dissipated to the hydraulic fluid return line so that constant pressure is maintained by the rotatory dies 34.

When the aperture opening 35 is to be "opened" so that the rotatory dies 34 are retracted, the open flow control valve 59*b* provides pressurized hydraulic fluid to the open cylinders 51*b*, 52*b* to thereby retract the rotatory dies 34. As hydraulic fluid is provided to the open cylinders 51*b*, 52*b*, hydraulic fluid is permitted to free flow through the close flow control valve 59*a* and return back into the open flow control valve 59*b* along with any additional fluid from the hydraulic pump.

Referring back to FIG. 6, as the fluted mandrel 36 having pipe 49 is forced through the rotatory dies 34 of the aperture means 31, the fluted mandrel 36 acts like a wedge. The motion attempts to force the rotatory dies 34 outwardly as the fluted mandrel 36 passes through the aperture means 31, and at the same time, the aperture means 31 itself receives a force in the direction of fluted mandrel motion. In order to counteract the latter force, braces 55 are positioned to support the front end of the aperture means 31, as shown in FIG. 6.

Figure 8:
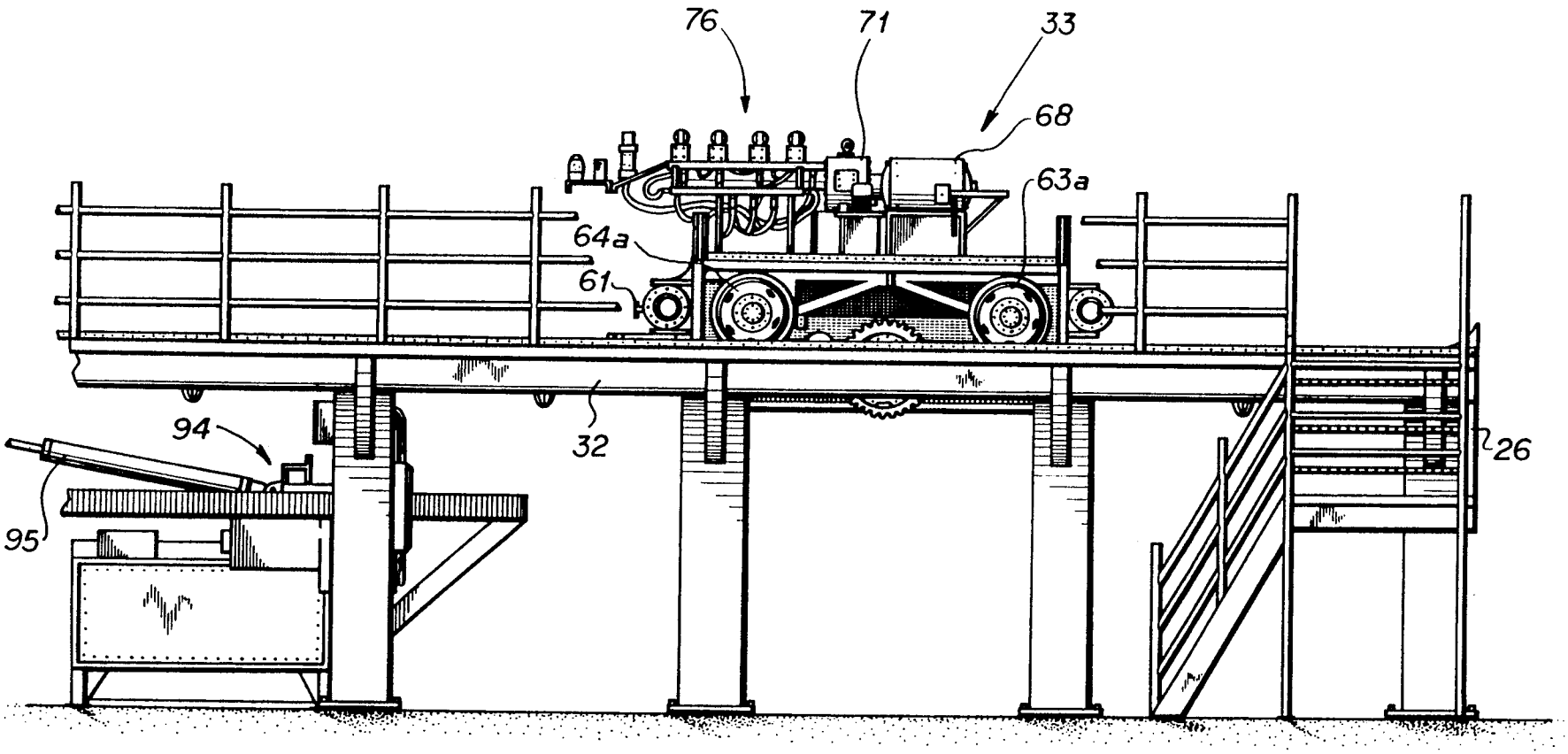
FIG. 8 illustrates an enlarged right hand side view of the carriage shown in FIG. 2.

FIG. 8 illustrates the carriage 33 for driving the fluted mandrel 36 to and from the aperture means 31. The fluted mandrel 36 has a mounting plate at its rear end which is bolted to a face plate 61 located at the front of the carriage 33.

Figure 9:
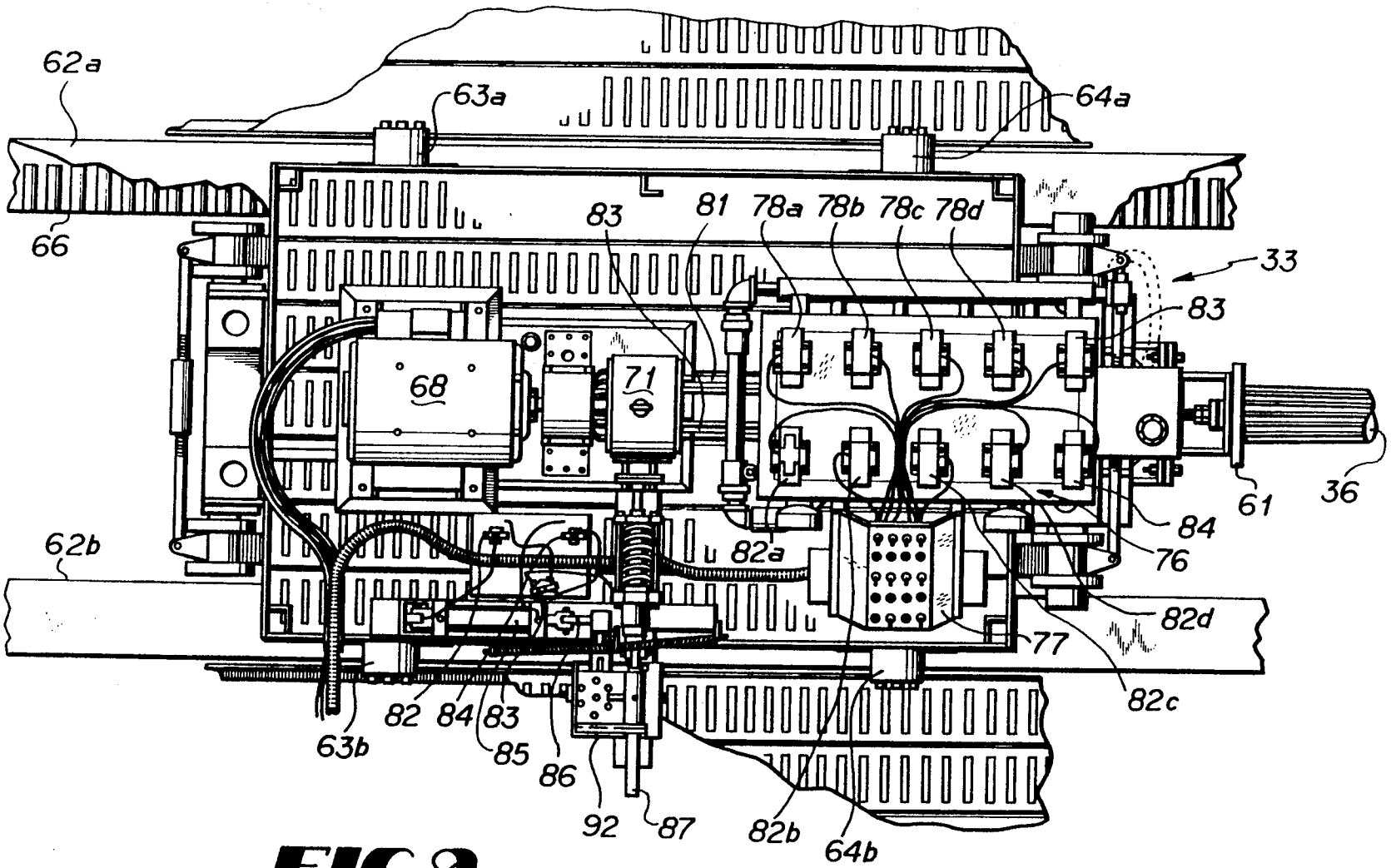
FIG. 9 illustrates an enlarged top view of the carriage of FIGS. 2 and 8.

As shown in FIG. 9, the carriage 33 rides along two metal H-beams 62*a*, 62*b* via respective metal wheels 63*a*, 63*b* and 64*a*, 64*b*. In the preferred embodiment, the metal wheels 63, 64 are commercially available tractor trailer rims wherein the lip on the rims is situated on the inner sides of the metal H-beams 62*a*, 62*b* so as to maintain the carriage 33 within the bounds of the track 32.

The driving force of the carriage 33 will now be described. From a high level conceptual vantage point, the driving force of the carriage 33 is generated by a system having an electrical means controlling a hydraulic means, in turn, controlling a mechanical means. This concept will be better understood in light of the following discussion.

Figure 10:
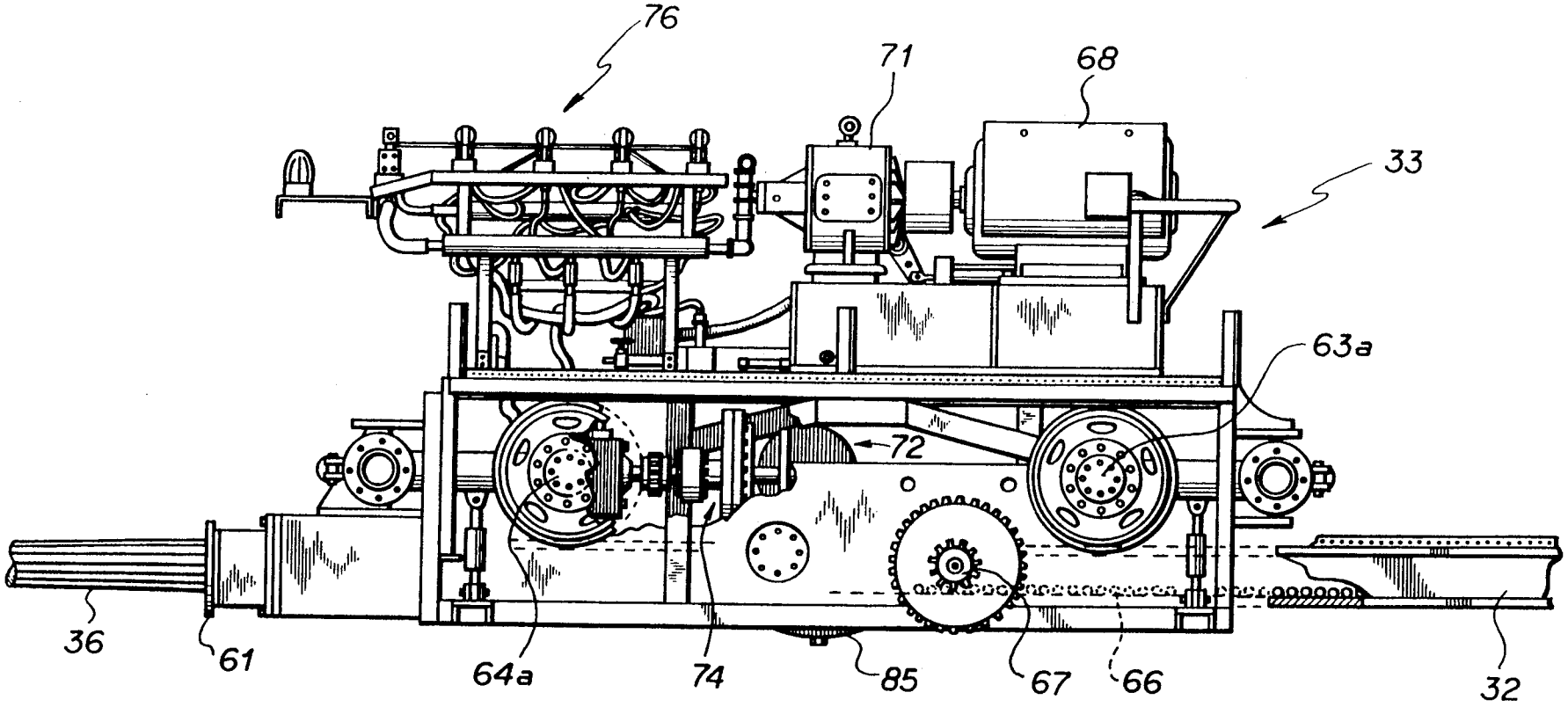
FIG. 10 illustrates an enlarged right hand side view of the carriage of FIGS. 2, 8, and 9 with a cut-away view showing the driving mechanism.

Specifically, referring to FIG. 10, a constant speed 75-horsepower electric motor 68 is disposed at the top of the carriage 33 so as to initiate the driving force via electrical power. The electric motor 68 drives a 70-horsepower, single direction, variable pitch, carriage hydraulic pump 71. The carriage hydraulic pump 71 ultimately drives a reversible 365-horsepower hydraulic motor 72. A plurality of hydraulic valves 76 controls the flow of hydraulic fluid through the carriage hydraulic pump 71 to the hydraulic motor 72.

In the preferred embodiment, ten solenoid-controlled hydraulic valves 78*a*–78*d*, 82*a*–82*d*, 83, 84, a top view of which is shown in FIG. 9, have been implemented to control the hydraulic fluid. Essentially, four of the solenoid-controlled hydraulic valves 78*a*–78*d* control the fluid within a first port 81 connected to the carriage hydraulic pump 71. Moreover, four other solenoid-controlled hydraulic valves 82*a*–82*d* control the hydraulic fluid within a second port 83 connected to the carriage hydraulic pump 71. When one set of valves 78 is providing hydraulic suction, the other set of hydraulic valves 82 is providing hydraulic pressure, and vice versa, depending upon the direction of hydraulic fluid defined by the carriage hydraulic pump 71. In addition, two safety relief valves 83, 84 can instantaneously dump hydraulic fluid from the main manifold so as to immediately stop the movement of the carriage 33. The safety relief valves 83, 84 are merely a safety feature and need not be implemented in order to practice the present invention.

Figure 11:
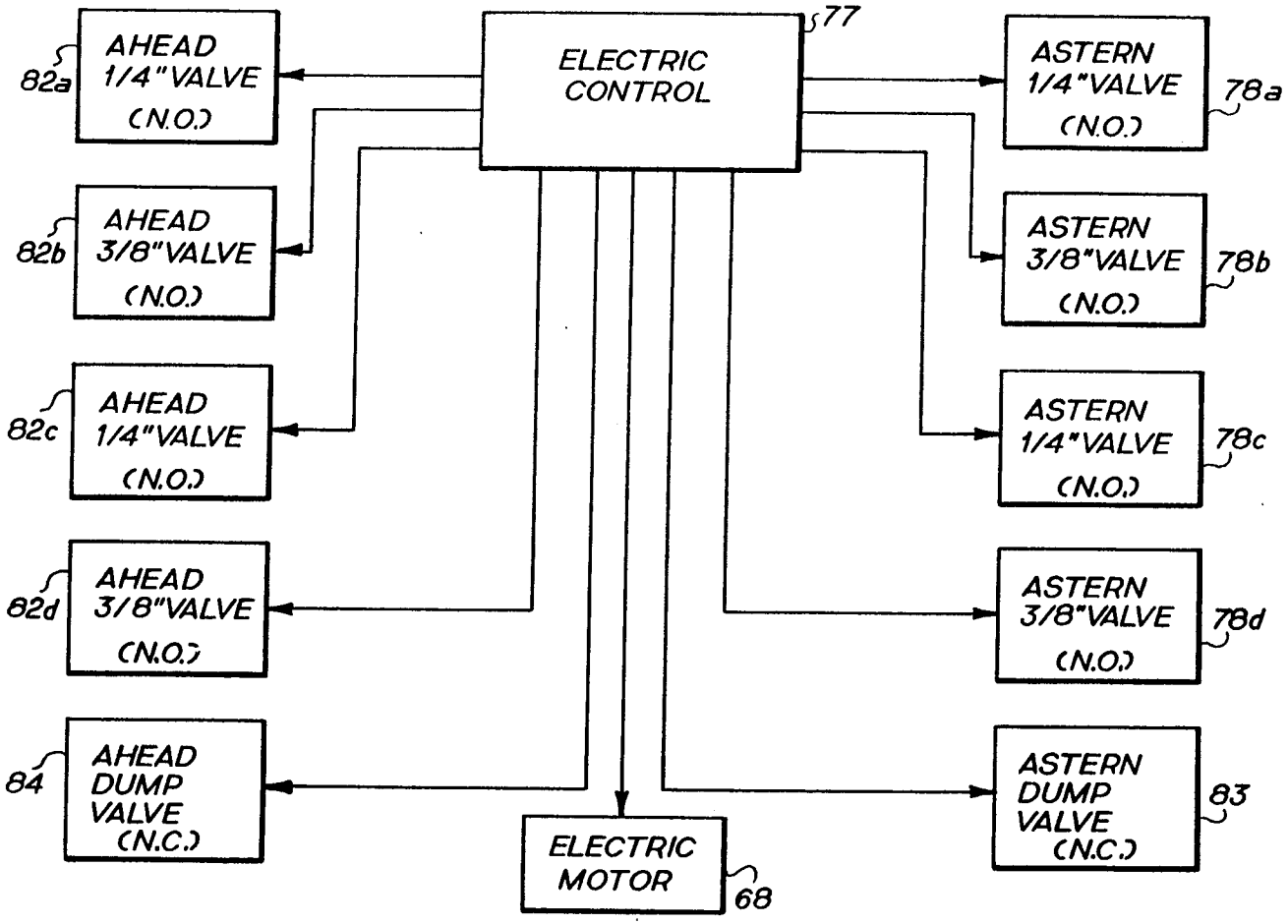
FIG. 11 is a block diagramic view of the carriage electrical system corresponding to the carriage of FIGS. 2 and 8 through 10.

The control and operation of the foregoing hydraulic valves 78 will be more fully described with reference to FIGS. 12 and 13 hereafter. Referring to FIG. 11, an electric control 77 is configured to independently control each of the hydraulic valves 78*a*–78*d*, 82*a*–82*d*, 83, 84. In the preferred embodiment, the hydraulic valves are solenoid-type valves and are merely switched to either an "on" status or an "off" status to affect the hydraulic fluid pressure. Also, in the preferred embodiment, only either the "ahead" valves 82*a*–82*d* or the "astern" valves 78*a*–78*d* are operative at any given instance. Other more sophisticated electrical control schemes are envisioned and could be implemented to practice the present invention.

Figure 12:
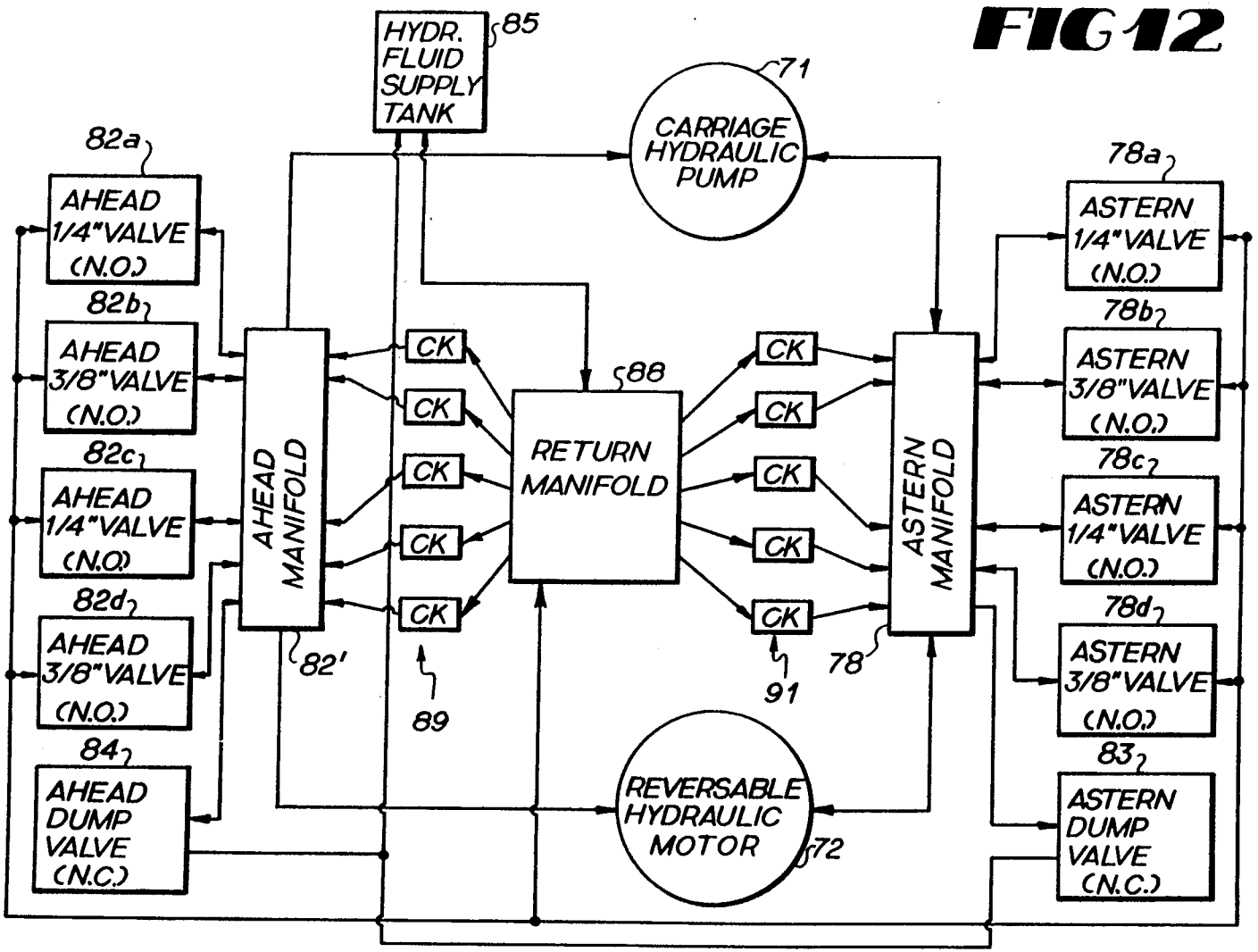
FIG. 12 is a block diagramic view of the carriage hydraulic system corresponding to the carriage of FIGS. 2 and 8 through 10.

As shown in FIG. 12, the carriage hydraulic system is a closed loop flow system which does not require a cooling means. A hydraulic fluid supply tank 85 supplies hydraulic fluid to the carriage hydraulic system. The carriage hydraulic pump 71 pumps hydraulic fluid either to the ahead manifold 82' or to the astern manifold 78'. The control of the hydraulic fluid direction will be described in detail later in this document in regard to FIG. 13 (air cylinder control system). Suffice it to say, if the carriage hydraulic pump 71 pumps hydraulic fluid to the ahead manifold 82', then the ahead manifold 82' supplies hydraulic pressure for driving the reversible hydraulic motor 72 so that the carriage commences forward towards the aperture means 31, while the astern manifold 78' provides hydraulic suction for the reversible hydraulic motor 72. Alternatively, if the carriage hydraulic pump 71 pumps hydraulic fluid to the astern manifold 78', then the astern manifold 78' supplies hydraulic pressure to the reversible hydraulic motor 72 so that the carriage is driven away from the aperture means 31, while the ahead manifold 82' provides hydraulic suction to the reversible hydraulic motor 72.

The ahead valves 82*a*–82*d* and the astern valves 78*a*–78*d* are normally open. Thus, at start, no significant pressure is applied to the reversible hydraulic motor 72 because hydraulic fluid flow is permitted to freely flow through the pressure manifold (either ahead or astern), through the corresponding pressure valves, and eventually to the hydraulic fluid supply tank 85 by way of a return manifold 88.

When the carriage 33 is to progress ahead, one or more of the ahead valves 82a–82d is closed. The closure of any of hydraulic valves 82a–82d causes pressure to build in the ahead manifold 82'. This pressure causes the reversible hydraulic motor 72 to move the carriage 33 in a forward direction. As more of the hydraulic valves 82a–82d are closed, more pressure and more driving force are supplied to the reversible hydraulic motor 72. In the preferred embodiment, the closure of each hydraulic valve causes an additional 60–70 psi to be applied to the reversible hydraulic motor 72.

Similarly, when the carriage 33 is to progress astern, one or more of the astern valves 78a–78d is closed. The closure of any of hydraulic valves 78a–78d causes pressure to build in the astern manifold 78'. This pressure causes the reversible hydraulic motor 72 to move the carriage 33 in a reverse direction away from the aperture means 31. As more of the hydraulic valves 78a–78d are closed, more pressure and more driving force are supplied to the reversible hydraulic motor 72.

The return manifold 88 of FIG. 12 with check valves 89, 91 are an optional safety feature in accordance with the present invention. The check valves 89, 91 are one way, spring-loaded valves in the preferred embodiment. The check valves prevent hydraulic fluid from flowing from the return manifold 88 into the pressure manifold, but permit the flow of hydraulic fluid from the return manifold 88 into the suction manifold. Significantly, if a break occurs in the carriage hydraulic system, the return manifold 88 via a set of check valves 89, 91 supplies the suction manifold with enough hydraulic fluid so that the hydraulic pump 71 or hydraulic motor 72 are not damaged.

Referring back to FIG. 10, the reversible hydraulic motor 72 directly drives a set of reduction gears connected to a drive shaft 74. The reduction gears provide a low range reduction of 48 to 1 and a high range reduction of 28 to 1. In turn, the drive shaft 74 drives pinions 67. Propulsion of the carriage 33 along the track 32 is accomplished by a rack and pinion configuration. A rack 66, shown by cut-away in FIG. 10, is situated on the lower inside edge of each metal H-beam 62a, 62b. The pinions 67 drive along the rack 66. Hence, for locomotion of the carriage 33, an electrical means (electric motor 68) controls a hydraulic means (carriage hydraulic pump 71, hydraulic valves 78, hydraulic motor 72), which in turn, controls a mechanical means (rack 66, pinion 67).

An important aspect of the present invention is that a constant carriage speed must be maintained for proper bending of flutes in the metal pipe 49. Further, it should be noted that the carriage 33 will experience varying resistances as the carriage 33 drives a fluted mandrel with the pipe 49 through the aperture means 31, primarily because of inherent variances in the pipe metal.

In order to compensate for varying drive resistances and also to control the direction of the carriage 33, the carriage 33 is equipped with an air cylinder control system. The structural components of the air cylinder control system are best illustrated in FIG. 9, which shows a top view of the carriage 33, and in FIG. 14, which shows a side view of the carriage 33.

Figure 14:
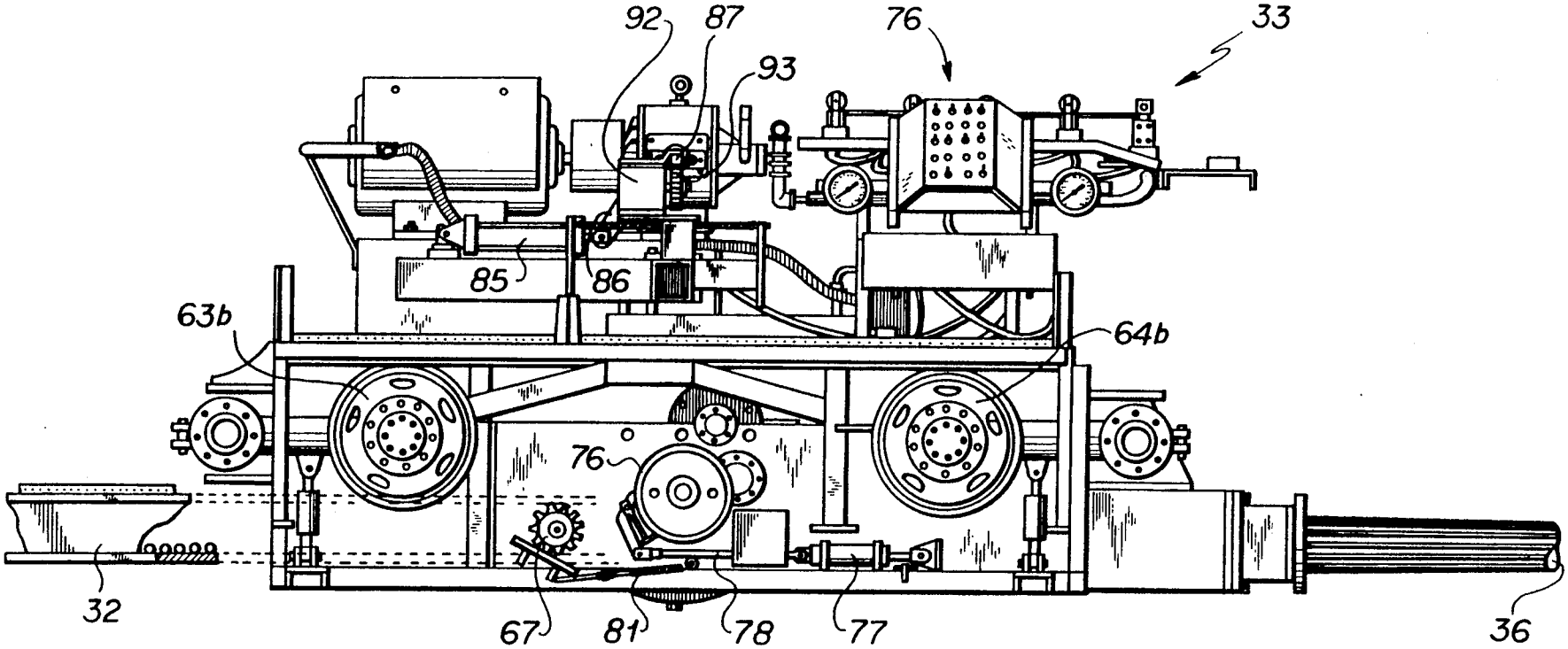
FIG. 14 shows a left hand side view of the carriage of FIGS. 2 and 8 through 10.

Referring first to FIG. 14, a stroke air cylinder 85 is connected via linkage 86 to a gear box 92. The gear box 92 drives a pinion 93. The pinion 93 rides on a rack facing downward on a control rod 87.

The control rod 87 is further illustrated in FIG. 9. In essence, the control rod 87 moves linearly so as to move an eccentric vane (not shown) within the carriage hydraulic pump 71 in response to air pressure within the stroke air cylinder 85. The positioning of the eccentric vane within the carriage hydraulic pump 71 controls the direction and pressure of hydraulic fluid through the carriage hydraulic pump 71.

Figure 13:
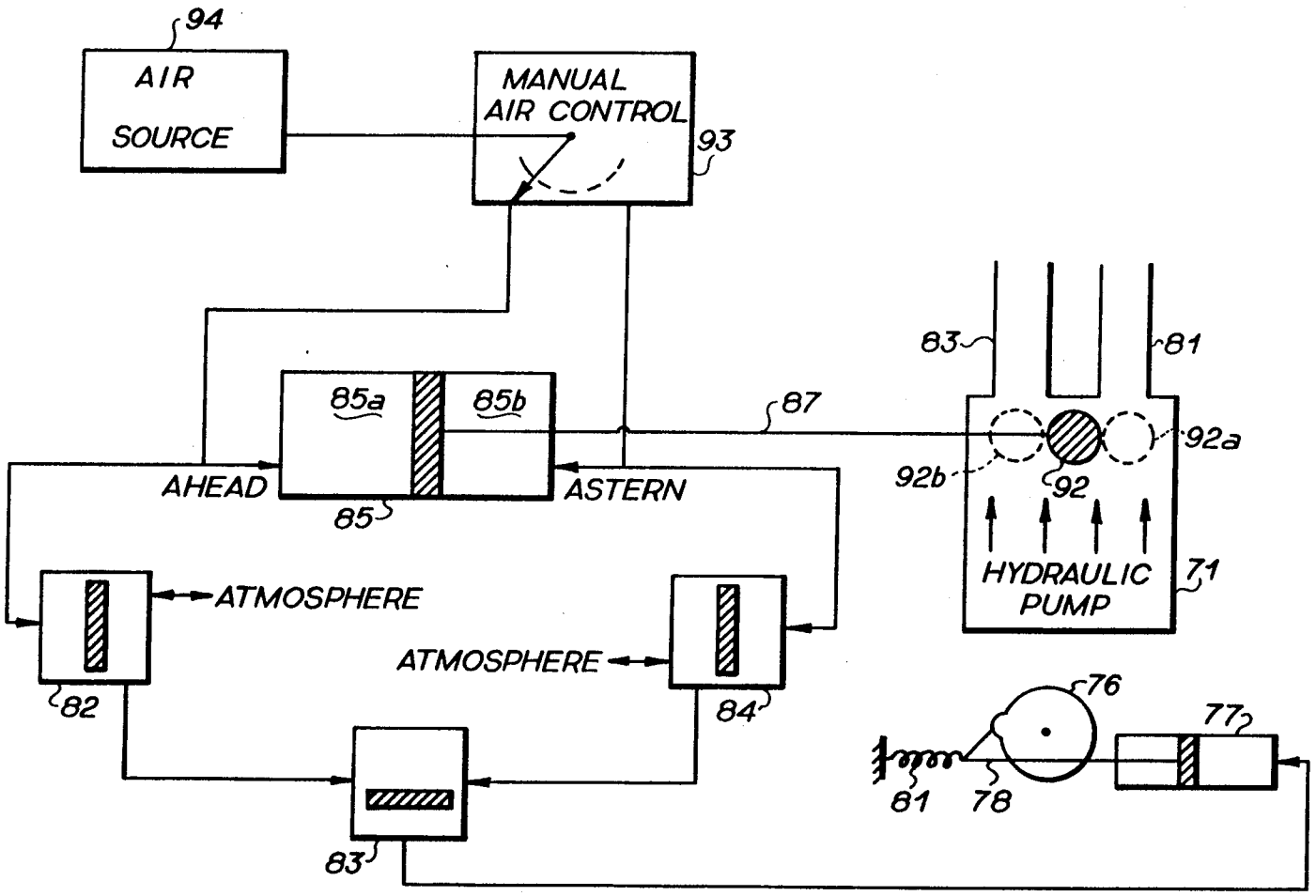
FIG. 13 is a block diagramic view of the air cylinder control system corresponding to the carriage of FIGS. 2 and 8 through 10.

Consider FIG. 13 which shows a schematic diagram of the air cylinder control system. In FIG. 13, the eccentric vane 92 is shown within the carriage hydraulic pump 71 having ports 81, 83. When the eccentric vane 92 is centered as shown, the pump 71 generates approximately 1200 psi through one of the ports 81, 83 at a certain flow rate. If the eccentric vane 92 is moved off center so as to "stroke" one of the ports 81, 83, then a lower flow rate and a higher hydraulic fluid pressure will result. The carriage hydraulic pump 71 can generate up to approximately 3500 psi in the preferred embodiment.

If the eccentric vane 92 is positioned to impede the flow of port 81, as shown by reference numeral 92a, then port 81 becomes hydraulic suction, and port 83 becomes hydraulic pressure. Furthermore, hydraulic valves 78a–78d become hydraulic suction and hydraulic valves 82a–82d become hydraulic pressure. In the foregoing scenario, the carriage 33 will progress ahead, or towards the aperture means 31.

Similarly, if the eccentric vane 92 within the carriage hydraulic pump 71 is positioned so as to impede hydraulic flow through the port 83, as indicated by reference numeral 92b, then the hydraulic valves 82a–82d become hydraulic suction and the hydraulic valves 78a–78d become hydraulic pressure. In the foregoing scenario, the carriage 33 will move away from the aperture means 31.

The stroke air cylinder 85 is controlled by a manually-operated bidirectional air valve 93. The bidirectional air valve 93 selectively applies air from a conventional air source 94 to either end of the stroke air cylinder 85. Air pressure applied to one end of the stroke air cylinder 85 will cause the carriage 33 to progress ahead, whereas air pressure applied to the opposite end will cause the carriage 33 to progress astern.

The speed of the carriage 33 is maintained constant as described hereafter with specific reference to FIG. 13. For simplicity, only the hypothetical scenario where the carriage 33 is moving toward the aperture means 31 is considered. However, the discussion is equally applicable to the scenario where the carriage 33 is moving astern.

In the present scenario, air pressure is applied to chamber 85a, thereby moving the control rod 87 to position the eccentric vane 92 to position 92a. If the carriage 33 experiences resistance as the carriage 33 moves toward the aperture means 31, the eccentric vane 92 will attempt to move towards the neutral center position of the carriage hydraulic pump 71. As the eccentric vane 92 attempts to move towards the center, the pressure in chamber 85b increases. A shuttle valve 84 will then open slightly to release part of the pressurized air to the atmosphere in order to prevent the eccentric vane 92 from moving to the center.

If the carriage 33 encounters less resistance as the carriage 33 travels ahead, then the eccentric vane 92 will attempt to move even further away from center. A shuttle valve 82 will then open slightly to release part of the pressurized air to the atmosphere in order to prevent the eccentric vane 92 from moving.

The braking mechanism for the carriage 33 is illustrated in FIG. 14. Essentially, the carriage 33 is stopped via a brake drum 76. A hydraulic brake cylinder 77 controls the braking of the brake drum 76 via a rod 78. A spring 81 is provided on the rod 78 so as to cause the brake to be applied when no air pressure is supplied to an air brake cylinder 77.

The air brake cylinder 77 is controlled by three air shuttle valves 82, 83, 84, best illustrated by the top view of the carriage 33 shown in FIG. 9. The brake is released by application of air from the air shuttle valve 83. The air shuttle valve 83 is supplied air from air shuttle valve 82 and/or air shuttle valve 84. As shown in FIG. 13, the air shuttle valve 82 is connected to the ahead end of the stroke air cylinder 85, while the air valve 84 is connected to the astern end of the stroke air cylinder 85. Because of the foregoing configuration, when pressure is applied by the manual air control 93 to either end of the stroke air cylinder 85, both of the hydraulic shuttle valves 82 and 84 are forced to close, and air pressure is forced into the shuttle valve 83. Moreover, the brake cylinder 77 is forced to neutralize the pull of spring 81, thereby releasing the brake drum 76. Thus, because of the foregoing three valve configuration, air can be provided to the air brake cylinder 77 for releasing the air brake without interfering with the stroke of the carriage hydraulic pump 71.

Figure 15A:
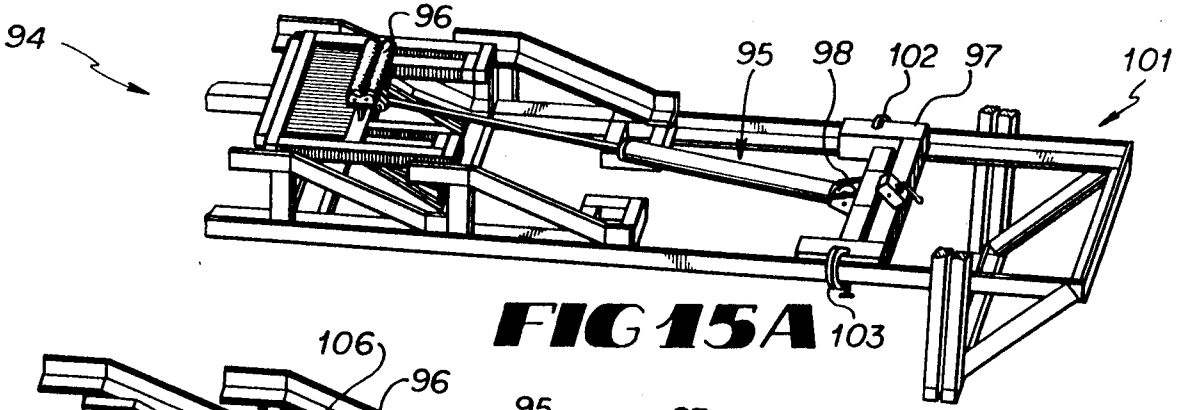
FIGS. 15A through 15C illustrate enlarged perspective views of the sled mechanism shown in FIGS. 6 and 8; more specifically.
Figure 15B:
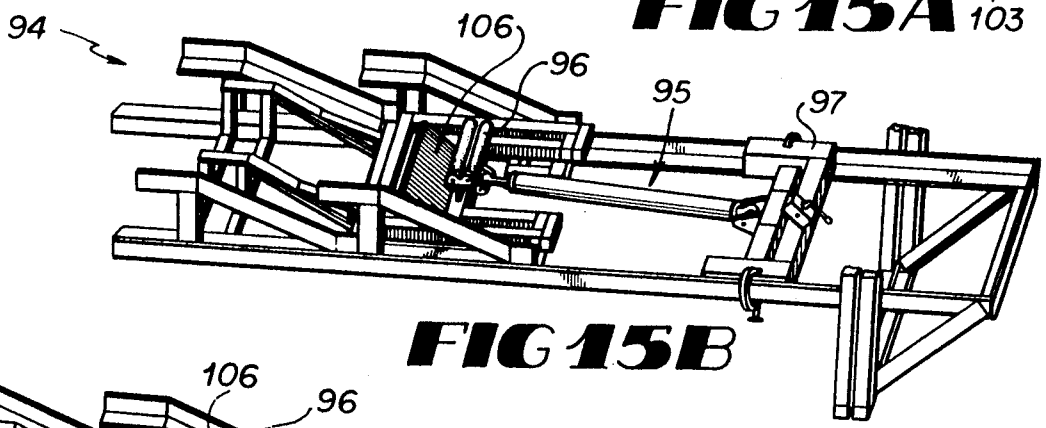
Figure 15C:
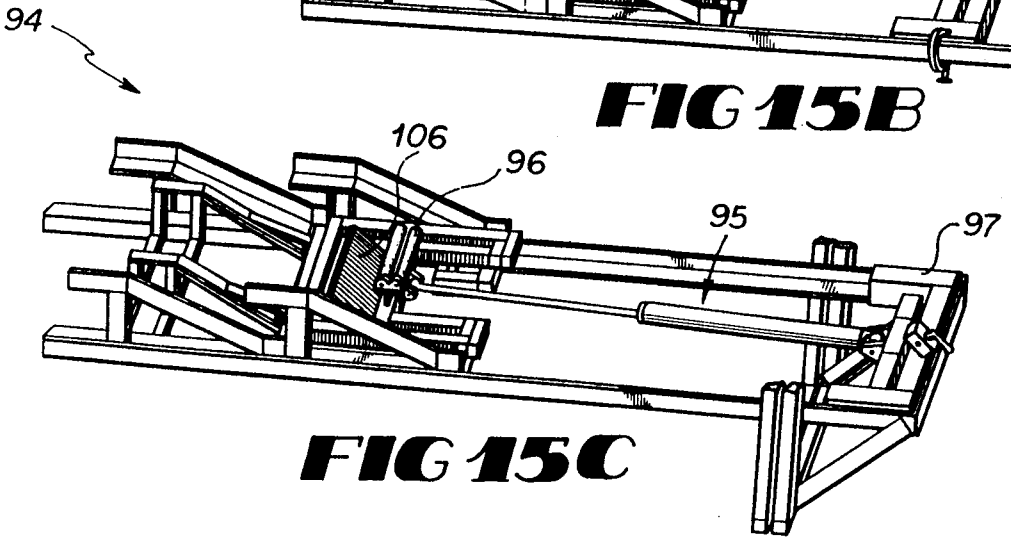

In accordance with another feature of the present invention, a sled 94 is provided under the track 32 so as to alleviate stress on the fluted mandrel and associated mounting plate 61 when the fluting machine 30 is inoperative. The location of the sled 94 is more clearly illustrated in FIG. 8. FIGS. 15A–15C illustrate more detail as well as various configurations of the sled 94.

With reference to FIG. 15A–15C, the sled 94 comprises an extendable sled arm 95 having rollers 96 for contacting the fluted mandrel 36. The sled arm 95 is pivotally mounted to a base 97 via a pivotal bracket 98, as shown in FIGS. 15A–15C. The base 97 is movable horizontally within a sled frame 101. The base 97 is clamped to the sled frame 101 by way of clamps 102, 103. The clamps 102, 103 permit movement of the base 97 so as to accommodate for different fluted mandrel lengths and different spacings between the carriage 33 and the aperture means 31.

FIG. 15A illustrates the sled 94 in operation wherein the sled arm 95 is in an upright position so as to support the fluted mandrel 36 by the rollers 96. In contrast, FIG. 15B shows the arm 95 in a retracted and downward position so that the rollers 96 will not come in contact with the fluted mandrel 36 when the sled 94 is not in operation. Worth noting is that the sled 94 is equipped with a trap door 106 in order to enable the rollers 96 and sled arm 95 to move downward away from the carriage 33 which moves overhead. Finally, FIG. 15C illustrates movement of the base 97 to the end of the frame 101. Hence, the sled 94 is a flexible and easily adjustable support apparatus for the fluted mandrel 36.

Figure 17:
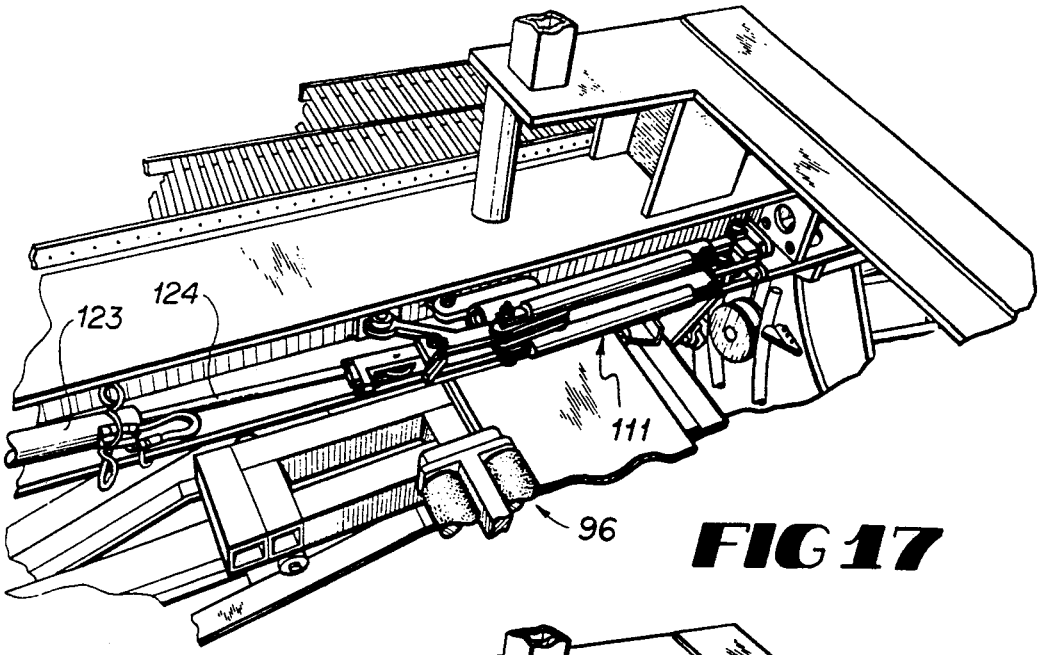
FIG. 17 illustrates a perspective view of the retraction of the fluted pole stripper of FIG. 16 when the fluted pole stripper is inoperative.
Figure 16:
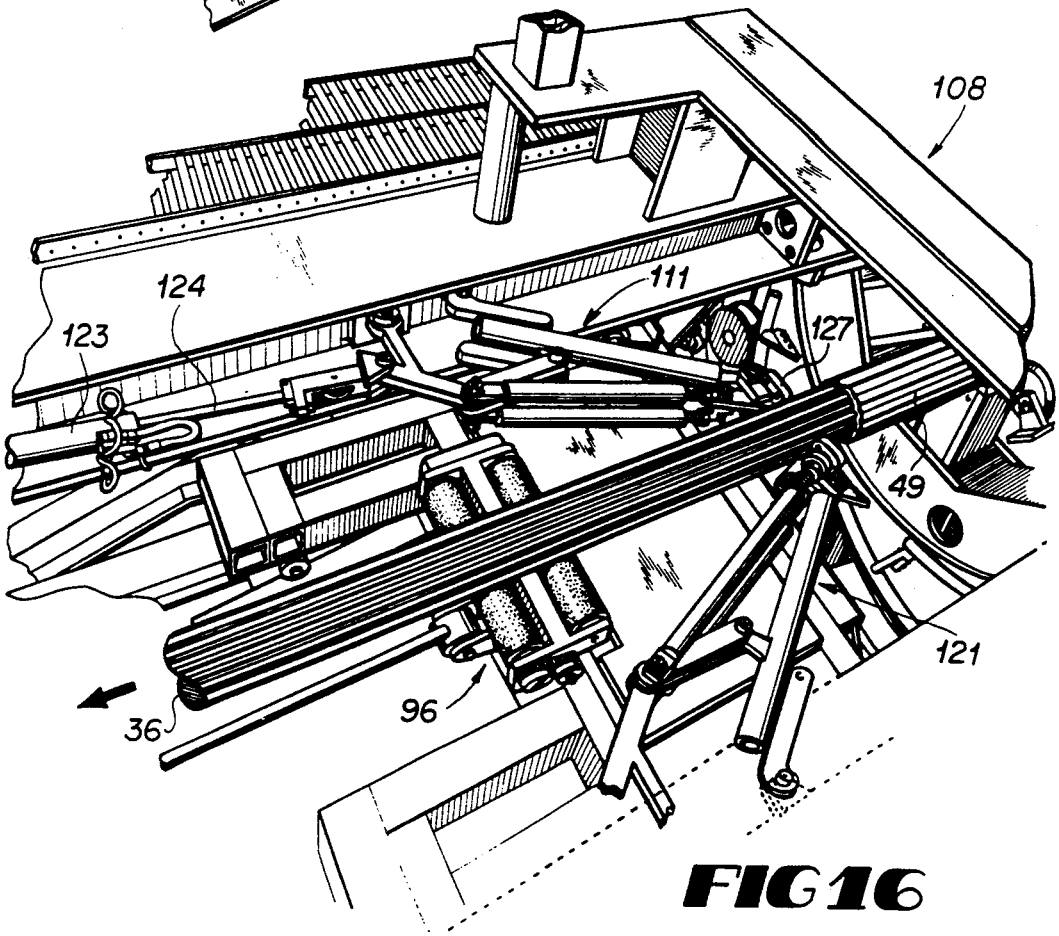
FIG. 16 illustrates a perspective view of a novel fluted pole stripper of the fluting machine of FIG. 2.

Yet another feature of the present invention is a fluted pole stripper 108, illustrated in FIGS. 16 and 17. The fluted pole stripper 108 has two stripper arms 111, 121. As shown in operation in FIG. 16, the stripper arms 111, 121 catch the edge of a finished fluted pole 122 in order to slide the finished fluted pole 122 from the fluted mandrel 36 moving in the direction indicated.

Figure 18:
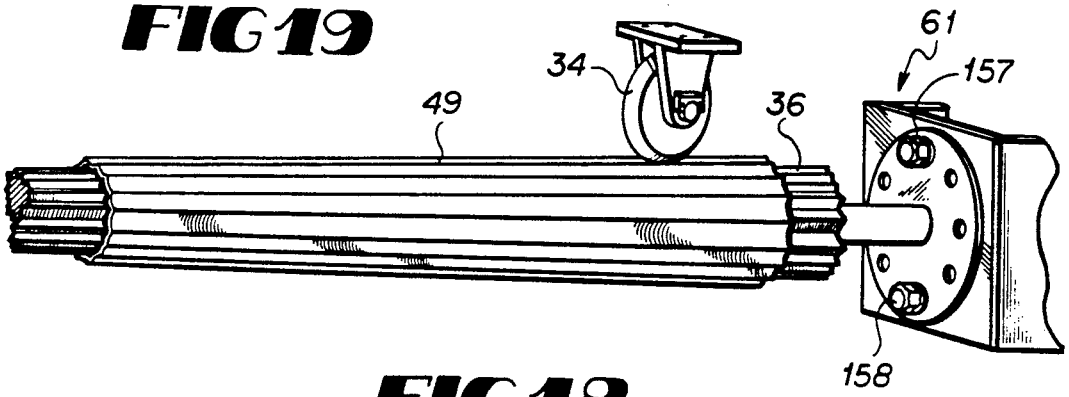
FIG. 18 illustrates a side view of the fluted mandrel mounted to the carriage of FIGS. 2 and 8 through 10.

For simplicity, FIG. 16 and 17 show only the details of the stripper arm 111. However, the discussion that follows in regard thereto is also applicable to the other stripper arm 121. As shown in FIGS. 17 and 18, the stripper arm 111 is driven by a hydraulic cylinder 123. The hydraulic cylinder 123 drives the stripper arm 111 by a linearly-moving control rod 124. The stripper arm 111 comprises a plurality of control rods configured so as to convert the linear motion of the control rod 124 into angular motion and thereby cause a stop 27 to come in contact with the fluted pole 122.

FIG. 17 merely shows the stripper arm 111 conveniently tucked away in a retracted position. The stripper arms 111, 121 are in a retracted position when the fluted pole stripper 108 is inoperative.

Figure 19:
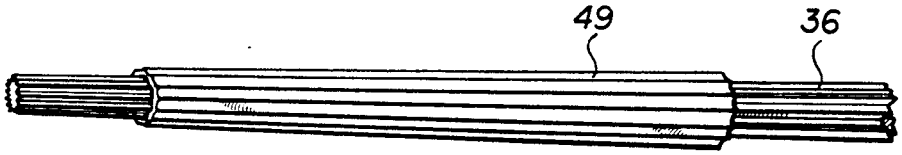
FIG. 19 illustrates a side view of a tapered fluted mandrel for the fluting machine of FIG. 2 in accordance with the present invention.

The fluted mandrel 36 in the preferred embodiment is tapered, as shown in FIGS. 18 and 19, so as to promote easy removal of a finished fluted pole 122 from the mandrel 36. This feature also provides an aesthetically pleasing taper to the finished fluted pole 122. When a tapered fluted mandrel 36 is utilized, the larger end of the fluted mandrel 36 is mounted to the carriage 33, as shown by mounting means 61 in FIG. 18. FIG. 18 further illustrates the ability to rotate the fluted mandrel 36 during different passes through the aperture means 31 via attachment bolts 157, 158.

Figure 20:
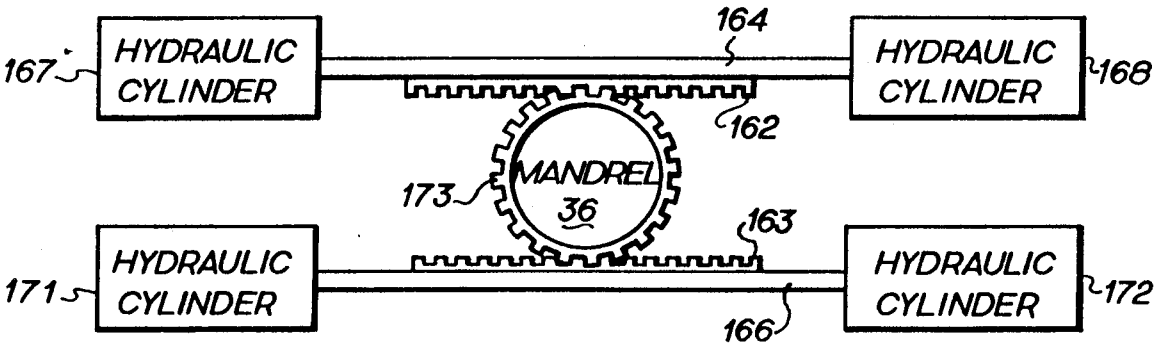
FIG. 20 shows a block diagramic view of an optional rotating means for rotating the fluted mandrel connected to the carriage of FIGS. 2 and 8.

An alternate means for rotation of the fluted mandrel 36 is shown in FIG. 20. In essence, the fluted mandrel 36 is hydraulically rotated. Racks 162, 164 are disposed on respective cylinder rods 164, 166 driven by respective hydraulic cylinder pairs 167, 168 and 171, 172. The teeth on racks 162, 164 engage the teeth 173 which are circumferentially situated about the end of the fluted mandrel 36, or around some linkage or connecting piece attached to the mandrel 36. Hence, in operation, the cylinder rods 164, 166 are forced in opposite directions so as to turn rotate the mandrel 36 in either the clockwise or counterclockwise direction (in terms of the cross section as shown in FIG. 20).

Figure 21:
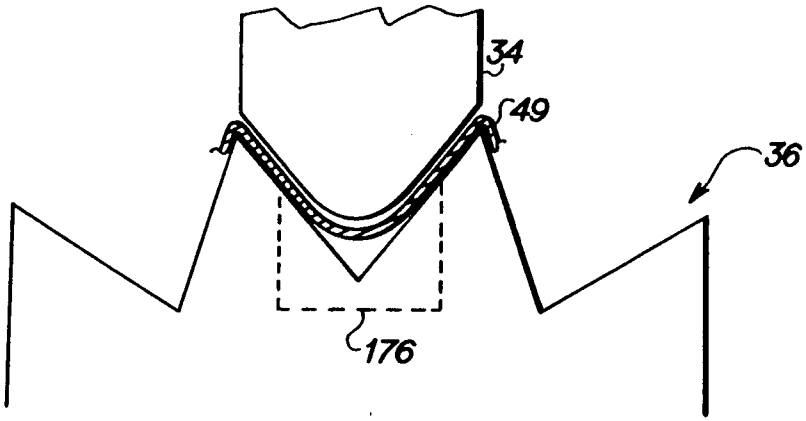
FIG. 21 shows a cross-sectional view of the fluted mandrel of FIG. 19 with a novel modification in accordance with the present invention.

In accordance with yet another feature of the present invention, the mandrel 36 is modified to further promote easier removal of a finished fluted pole from the mandrel 36. As shown in FIG. 21, the flute in the mandrel 36 are modified as indicated by phantom reference line 176. Essentially, the valley of each mandrel flute is cut away so that less of the mandrel 36 contacts the pipe 49 being worked upon by the die 34. Because less of the pipe 49 binds to the mandrel 36, the pipe 49 can more easily be pulled from the mandrel 36.

Figure 22:
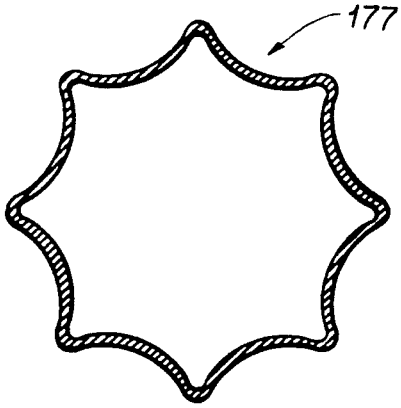
FIGS. 22 through 24 illustrate cross-sectional views of various types of fluted poles which can be produced by the fluting machine of FIG. 2; more specifically.
Figure 23:
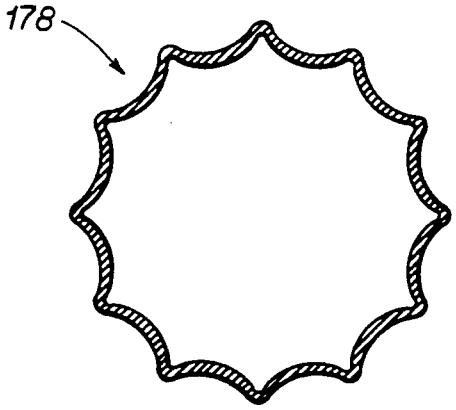

The fluting machine 30 of the present invention can be used to produce a variety of fluted poles. Any even number of flutes can be impressed on a pipe to form a fluted pole. FIG. 22 shows a fluted pole 177 having eight flutes which can be produced by the fluting machine 30. FIG. 23 shows a fluted pole 178 having twelve flutes created by the fluting machine 30. Furthermore, FIG. 24 shows a fluted pipe 179 having sixteen flutes.

The fluted poles 177–179 can be created by the fluting machine 30 using several different procedures. For example, consider the fluted pole 177 of FIG. 22. In order to produce the fluted pole 177, a pipe can be passed through the aperture means 31 a single time with eight rotatory dies 34 in operation. An alternative would be to pass a pipe through the aperture means 31 two times with four rotatory dies 34 in operation and with a slight rotation in the pipe for each pass. Still another alternative would be to pass a pipe through the aperture means 31 four times with two opposing rotatory dies 34 in operation and with a slight rotation in the pipe for each pass.

Figure 24:
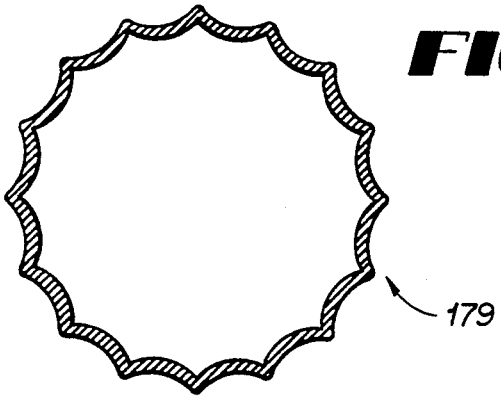

It is important to note that the thickness of the finished fluted pipes 177–179 shown in respective FIGS. 22–24 is uniform throughout. This feature enhances the overall strength of the finished fluted pole in contrast to embodiments of the prior art where thicknesses vary throughout the pole structure.

II. Operation of Fluting Machine

Figure 25:
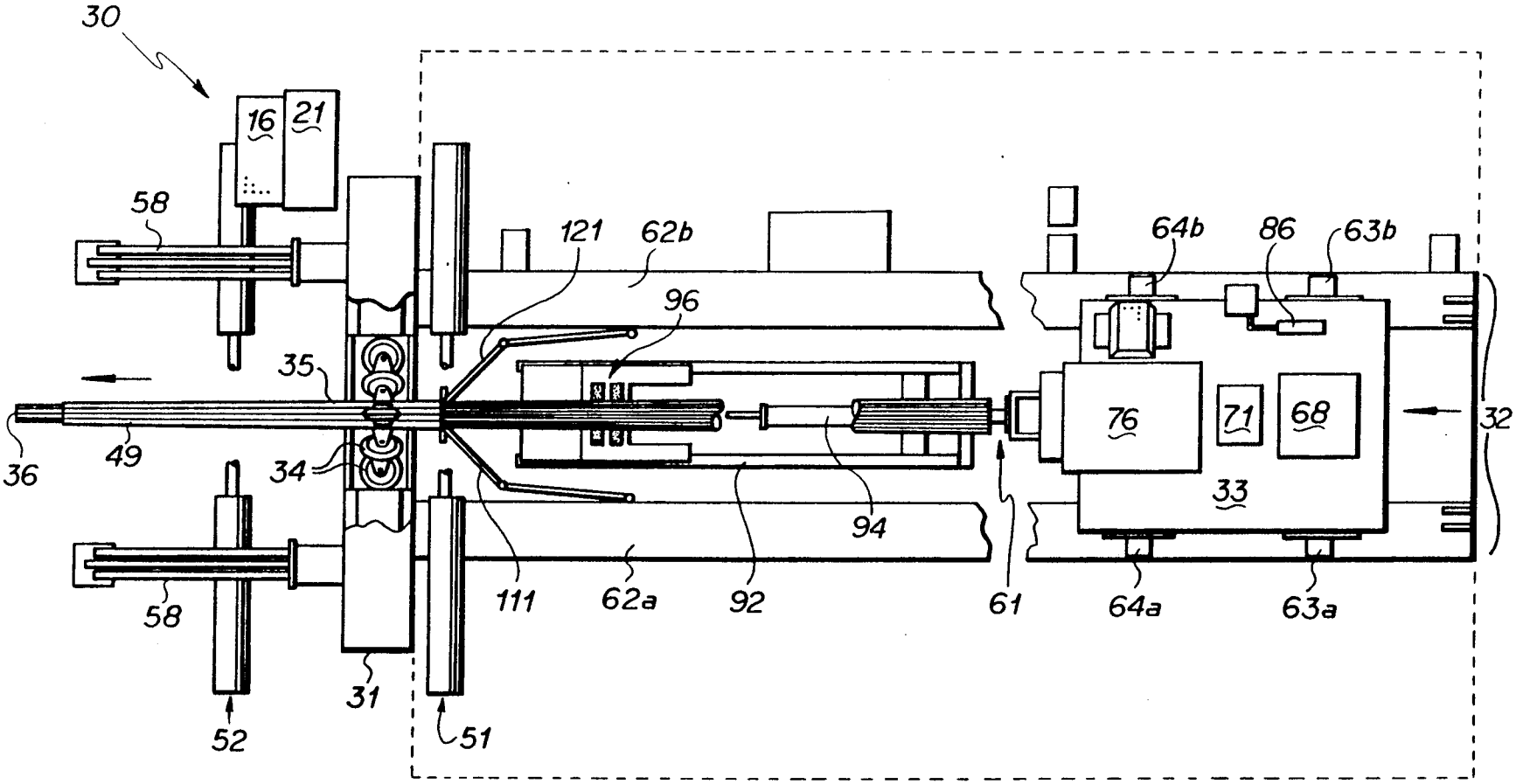
FIG. 25 shows a top block diagramic view of the fluting machine of FIG. 2 in accordance with the present invention.

The operation of the fluting machine 30 for producing a fluted pole is described in detail hereafter with reference to the top view schematic diagram of FIG. 25.

When the fluting machine 30 is inoperative, the carriage 33 is situated near the end of track 32 away from the aperture means 31, as shown in FIG. 24. Moreover, the sled arm 95 is positioned upward with rollers 96 so as to support the fluted mandrel 36. When the fluting machine 30 is to be operated, the sled arm 95 is recessed downward so as to clear the way for the carriage 33.

The stripper arms 111, 121 of the fluted pole stripper 108 can also be in a closed position when the fluting machine 30 is inoperative, as shown in FIG. 25, so as to further stabilize the support of the fluted mandrel 36. However, needless to say, the stripper arms 111, 121 must be moved away from the fluted mandrel 36 before the carriage 33 can progress towards the aperture means 31.

In order to commence motion of the carriage 33, the electric motor 68 is powered to an "on" status. The rotation of the electric motor 68 creates hydraulic pressure in the carriage hydraulic pump 71 and associated hydraulic network. Initially, the eccentric vane within the carriage hydraulic pump 71 is positioned in the center so that no significant hydraulic pressure is generated. In other words, the carriage 33 is effectively in neutral.

However, worth noting is that enough pressure is generated so as to cause the reversible hydraulic motor 72 to tighten the gears driving the drive shaft. This eliminates gear grinding when the carriage 33 begins to move.

In order to cause the carriage 33 to move towards the aperture means 31, the eccentric vane within the carriage hydraulic pump 71 is moved off center so as to cause the carriage 33 to move towards the aperture means 31. The driving force of the carriage 33 toward the aperture means 31 can be progressively increased by progressively closing the ahead valves 82*a*–82*d*, respectively.

Furthermore, as the carriage 33 moves towards the aperture means 31, the novel carriage air control system compensates for variations in drive force resistance. The carriage air control system senses drive resistance and moves the eccentric vane so as to modify the driving force of the carriage 33. Consequently, movement of the carriage 33 is maintained at a constant speed.

After the carriage 33 has arrived in close proximity to the aperture means 31, i.e., after the fluted mandrel 36 is substantially extended through the aperture opening 35 of the aperture means 31, the carriage 33 is either put in neutral or is turned off. At this point, a pipe can be introduced onto the fluted mandrel 36.

After the pipe 49 has been placed on the fluted mandrel 36, the carriage 33 is forced to return to the rear end of the track 32, as shown in FIG. 25. The carriage 33 is forced to travel astern moving the eccentric vane in the carriage hydraulic pump 71 off center once again. Furthermore, the driving force of the carriage 33 away from the aperture means 31 can be progressively increased by progressively closing the astern valves 78*a*–78*d*, respectively.

Next, the aperture means 31 is forced to rotate in a counterclockwise direction in order to cause the rotatory dies 34 to extend within the aperture opening 35 of the aperture means 31. After the rotatory dies 34 have created a barrier in the aperture opening 35, the carriage 33 is forced to move towards the aperture means 31. When the pipe 49 on the fluted mandrel 36 comes in contact with the rotatory dies 34, the pipe 49 acts like a wedge. The increase in drive resistance experienced by the carriage 33 is compensated for by the novel carriage air control system so as to maintain the speed of the carriage 33 at a constant rate.

The rotatory dies 34 roll as the pipe 49 is forced between them. Equal force is applied by all rotatory dies 34 about the circumference of the pipe 49 as a result of the novel aperture means 31. The rotatory dies 34 bend the pipe 49 so as to form flutes in the pipe 49. The carriage 33 continues towards the aperture means 31 until the entire length, or a desired part thereof, is fluted.

Generally, only one pass of the pipe 49 through the aperture means 31 is necessary to accomplish the creation of a flute within the pipe 49. However, some stronger materials may be utilized for the pipe 49, thus requiring several passes through the aperture means 31. It should be noted that the pipe 49 can be operated upon by the aperture means 31 in either direction because of the bidirectional driving ability of the carriage 33.

Additionally, the fluted mandrel 36 and pipe 49 can be rotated at the mounting means 61 so as to accommodate for certain types of fluted poles, as previously discussed in relation to FIGS. 22 through 24.

After the fluted pole 122 has been completed, the rotatory dies 34 in the aperture means 31 are retracted by rotating the aperture means in a clockwise direction. After the rotatory dies 34 have been retracted, the carriage 33 is moved, if necessary, in close proximity to the aperture means 31 so that the fluted mandrel 36 with the finished fluted pole 122 extend through the aperture opening 35.

Next, the stripper arms 111, 121 are brought to a closed position, as shown in FIG. 25, so as to effectively catch the edge of the finished fluted pole 122. The carriage 33 then is caused to move astern, or away from the aperture means 31. As a result of the foregoing operation, the finished fluted pole 122 is forced to remain stationary while the fluted mandrel 36 moves with the carriage 33 away from the aperture means 31. Eventually, the fluted mandrel 36 will free itself from the finished fluted pole 122. The finished fluted pole 122 can then be carried away and used for its intended purpose.

It will be obvious to those skilled in the art that many variations may be made to the preferred embodiment without departing from the novel teachings of the present invention. All such variations are intended to be incorporated herein and within the scope of the following claims.

The inventor claims the following separate and distinct inventions:

1. A fluting machine for producing fluted poles, comprising:

a track;

a carriage adapted to ride on said track, said carriage having a fluted mandrel for holding a pipe to be fluted, said carriage for driving said fluted mandrel parallel to said track at a constant speed irrespective of fluctuations in driving resistance; and an aperture means having a stationary inner part, a rotatable outer head, rotatory dies circumferentially situated about and perpendicularly extendable within an aperture opening defined by said stationary inner part, and a means for rotating said outer head, said aperture opening for accepting said fluted mandrel and pipe therethrough, said rotatable outer head having cam means including curvilinear tracks disposed about said aperture opening and rollers driven by said curvilinear tracks, each of said rollers being associated with a corresponding rotatory die and being driven by a pair of said curvilinear tracks so that said rotatory dies are concurrently moved radially within said aperture opening upon rotation of said rotatable outer head.

2. The fluting machine of claim 1, wherein said carriage further comprises a means for driving said fluted mandrel parallel to said track at a constant speed irrespective of fluctuations in driving resistance.

3. The fluting machine of claim 1, wherein said rotatory dies are symmetrically spaced about said aperture opening so that each of said rotatory dies has an opposing rotatory die applying equal opposing force in a direction of said fluted mandrel.

4. The fluting machine of claim 1, further comprising a sled movable in a direction parallel to said track, said sled having an extendable arm means for supporting said fluted mandrel at a selectable distance from said carriage.

5. The fluting machine of claim 1, wherein said carriage is adapted to move along said track via a drive shaft acting as a pinion driven by said carriage riding on said track configured as a rack.

6. The fluting machine of claim 1, wherein said carriage further comprises the following:

an electrical motor;

a hydraulic pump for pumping hydraulic fluid to a plurality of valves, said pump having two hydraulic fluid ports disposed at one end and being driven by said electrical motor at another end, said pump having an eccentric vane for impeding flow of hydraulic fluid through either of said ports to thereby define a direction and pressure of hydraulic fluid;

a stroke air cylinder connected to said eccentric vane by a stroke rod and adapted to control the direction and pressure of hydraulic fluid through said hydraulic pump via moving said eccentric vane to either partially or fully impede one of said ports, said stroke air cylinder for moving said eccentric vane in response to resistance experienced by said carriage so as to increase the pressure of hydraulic fluid and thereby maintain said carriage at constant speed; and a hydraulic motor driven by said hydraulic fluid and controlled directly by said plurality of valves, said hydraulic motor being connected to a drive shaft for propelling said carriage along said track.

7. The fluting machine of claim 1, further comprising a stripper means for sliding said pipe along said mandrel, said stripper means comprising opposing stripper arms, each having a stop at a distal end capable of moving toward said mandrel for contacting an edge of said pipe in order to stop movement of said pipe relative to said mandrel.

8. The fluting machine of claim 1, wherein said fluted mandrel comprises a recess in each flute of said mandrel for permitting easy removal of said pipe from said mandrel.

9. A fluting machine for producing fluted poles, comprising:

a track;

a carriage adapted to ride on said track, said carriage adapted to drive a fluted mandrel parallel to said track, said fluted mandrel adapted to hold a pipe to be fluted;

aperture means having rotatory dies circumferentially situated about an aperture opening for accepting said fluted mandrel therethrough, said rotatory dies movable perpendicular to said fluted mandrel within said aperture opening, each of said rotatory dies configured to produce a flute in said pipe; and a driving means for moving said carriage along said track, said driving means for driving said fluted mandrel at a constant speed regardless of changes in driving resistance, said driving means comprising:

an electrical motor;

a hydraulic pump for pumping hydraulic fluid to a plurality of valves, said pump having two hydraulic fluid ports disposed at one end and being driven by said electrical motor at another end, said pump having an eccentric vane for impeding flow of hydraulic fluid through either of said ports to thereby define a direction and pressure of hydraulic fluid;

a stroke air cylinder connected to said eccentric vane by a stroke rod and adapted to control the direction and pressure of hydraulic fluid through said hydraulic pump via moving said eccentric vane to either partially or fully impede one of said ports, said stroke air cylinder for moving said eccentric vane in response to said changes in said driving resistance experienced by said carriage so as to increase the pressure of hydraulic fluid and thereby maintain said carriage at said constant speed; and a hydraulic motor driven by said hydraulic fluid and controlled directly by said plurality of valves, said hydraulic motor being connected to a drive shaft for propelling said carriage along said track.

10. The fluting machine of claim 9, wherein said aperture means comprises a rotatable outer head and a stationary inner part defining said aperture opening, said rotatable outer head for causing extension of said rotatory dies within said aperture opening and against said pipe on rotation of said rotatable outer head.

11. The fluting machine of claim 9, wherein said aperture means further comprises a rotatable outer head and a stationary inner part defining said aperture opening, said rotatable outer head having cam means including curvilinear tracks disposed about said aperture opening and rollers driven by said curvilinear tracks, said each of said rollers corresponding with a rotatory die, said rollers for causing either extension or retraction of said rotatory dies concurrently relative to said aperture opening upon rotation of said rotatable outer head.

12. The fluting machine of claim 9, wherein said rotatory dies are symmetrically spaced about said aperture opening so that each of said rotatory dies has an opposing rotatory die applying equal opposing force in a direction of said fluted mandrel.

13. The fluting machine of claim 9, further comprising a sled movable in a direction parallel to said track, said sled having an extendable arm means for supporting said fluted mandrel at a selectable distance from said carriage.

14. The fluting machine of claim 9, wherein said rotatory dies each further comprise a wheel-like structure capable of rotation about an axis affixed to a piston, said wheel-like structure having a V-shaped outer surface for bending a flute in said pipe, said piston being driven by a corresponding roller.

15. The fluting machine of claim 9, wherein said fluted mandrel comprises a recess in each flute of said mandrel for permitting easy removal of said pipe from said mandrel.

16. The fluting machine of claim 9, further comprising a stripper means for sliding said pipe along said mandrel, said stripper means comprising opposing stripper arms, each having a stop at a distal end which is moved toward said mandrel for contacting the longitudinal end of said pipe in order to stop movement of said pipe while permitting movement of said mandrel therethrough.

17. A fluting machine for producing fluted poles, comprising:

a track having parallel rails;

a carriage adapted to ride along said parallel rails carrying a fluted mandrel, said fluted mandrel for holding a pipe to be fluted, said carriage adapted to move along said rails via a drive shaft connected to a pinion which engages a rack on said rails;

aperture means having rotatory dies circumferentially situated about an aperture opening for accepting said fluted mandrel therethrough, said rotatory dies movable perpendicular to said fluted mandrel within said aperture opening, each of said rotatory dies having a wheel-like structure capable of rotation about an axis affixed to a piston, said wheel-like structure having a V-shaped outer surface for bending a flute in said pipe, said rotatable outer head having cam means including curvilinear tracks disposed about said aperture opening and rollers driven by said curvilinear tracks, each of said rollers being associated with a corresponding piston and a rotatory die and being driven by a pair of said curvilinear tracks so that said rotatory dies is moved either inward or outward relative to said aperture opening upon rotation of said rotatable outer head; and a driving means for moving said carriage along said track, said driving means for driving said fluted mandrel at a constant speed regardless of changes in driving resistance, said driving means comprising:

an electrical motor;

a hydraulic pump for pumping hydraulic fluid to a plurality of valves, said pump having two hydraulic fluid ports disposed at one end and being driven by said electrical motor at another end, said pump having an eccentric vane for impeding flow of hydraulic fluid through either of said ports to thereby define a direction and pressure of hydraulic fluid;

a stroke air cylinder connected to said eccentric vane by a stroke rod and adapted to control the direction and pressure of hydraulic fluid through said hydraulic pump via moving said eccentric vane to either partially or fully impede one of said ports, said stroke air cylinder for moving said eccentric vane in response to said changes in said driving resistance experienced by said carriage so as to increase the pressure of hydraulic fluid and thereby maintain said carriage at said constant speed; and a hydraulic motor driven by said hydraulic fluid and controlled directly by said plurality of valves, said hydraulic motor being connected to a drive shaft for propelling said carriage along said track.

* * * * *